US011217175B2

(12) United States Patent
Teng et al.

(10) Patent No.: US 11,217,175 B2
(45) Date of Patent: Jan. 4, 2022

(54) PIXEL-DRIVING CIRCUIT AND METHOD, AND A DISPLAY UTILIZING THE SAME

(71) Applicant: BOE TECHNOLOGY GROUP CO., LTD., Beijing (CN)

(72) Inventors: Wanpeng Teng, Beijing (CN); Xueling Gao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/772,796

(22) PCT Filed: Dec. 9, 2019

(86) PCT No.: PCT/CN2019/123932
§ 371 (c)(1),
(2) Date: Jun. 14, 2020

(87) PCT Pub. No.: WO2020/140694
PCT Pub. Date: Jul. 9, 2020

(65) Prior Publication Data

US 2021/0225288 A1 Jul. 22, 2021

(30) Foreign Application Priority Data

Jan. 4, 2019 (CN) ..... 201910009444.4

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0819* (2013.01);
(Continued)

(58) Field of Classification Search
CPC .. G09G 3/3258; G09G 3/3233; G09G 3/3291; G09G 2300/0819;
(Continued)

(56) References Cited

U.S. PATENT DOCUMENTS 11,087,685 B1 * 8/2021 Lu ..... G09G 3/3233
2013/0099692 A1 * 4/2013 Chaji ..... G09G 3/3233 315/224
(Continued)

FOREIGN PATENT DOCUMENTS

CN 107452331 A 12/2017
CN 107452334 A 12/2017
(Continued)

OTHER PUBLICATIONS

CN First Office Action in Application No. 201910009444.4, dated Mar. 3, 2020.
(Continued)

*Primary Examiner* — Tom V Sheng
(74) *Attorney, Agent, or Firm* — Syncoda LLC; Feng Ma

(57) ABSTRACT

A pixel-driving circuit includes: a write-compensation sub-circuit coupled to a signal scanning terminal, a data terminal and a driving sub-circuit, and configured to, controlled with voltage from the signal scanning terminal, provide voltages of the data terminal to the driving sub-circuit for compensation; the light-emission control sub-circuit is coupled with the light-emission terminal, the first power source terminal and the driving sub-circuit and configured to provide voltages of the first power source terminal to the first terminal of the driving transistor controlled with voltage from the light-emission control terminal; the reset sub-circuit is coupled with the reset signal terminal, the initial voltage terminal, and the driving sub-circuit and to provide voltages of the initial voltage terminal to the gate of the driving
(Continued)

transistor controlled with voltage from the reset signal terminal, causing the driving transistor to be in ON and OFF states respectively during the first and second initialization phases.

20 Claims, 17 Drawing Sheets

(52) U.S. Cl.
CPC ..... *G09G 2310/0251* (2013.01); *G09G 2320/0233* (2013.01); *G09G 2320/0257* (2013.01); *G09G 2330/028* (2013.01)

(58) Field of Classification Search
CPC ... G09G 2310/0251; G09G 2320/0233; G09G 2320/0257; G09G 2320/045; G09G 2320/043; G09G 2330/028
USPC ..... 345/691
See application file for complete search history.

(56) References Cited

U.S. PATENT DOCUMENTS

2013/0300724 A1* 11/2013 Chaji ..... G09G 3/3283 345/212
2014/0300281 A1* 10/2014 Chaji ..... G09G 3/3233 315/161
2016/0063922 A1* 3/2016 Tsai ..... G09G 3/3291 345/76
2018/0130411 A1* 5/2018 Zhou ..... G09G 3/3225
2018/0130412 A1* 5/2018 Zhang ..... G09G 3/3258
2018/0342199 A1* 11/2018 Zhou ..... G09G 3/32
2019/0096327 A1* 3/2019 Peng ..... G09G 3/3241
2019/0114960 A1* 4/2019 Lee ..... G09G 3/3233
2019/0156750 A1* 5/2019 Dong ..... H01L 27/3276
2019/0189055 A1* 6/2019 Zhang ..... H01L 27/12
2019/0362670 A1* 11/2019 Liu ..... G09G 3/3233
2020/0160788 A1* 5/2020 Son ..... G09G 3/2003
2020/0160795 A1* 5/2020 Heo ..... G09G 3/3291
2020/0219445 A1* 7/2020 Qing ..... G09G 3/3258

FOREIGN PATENT DOCUMENTS

CN 107945743 A 4/2018
CN 108154845 A 6/2018
CN 108806601 A 11/2018

OTHER PUBLICATIONS

International Search Report in Application No. PCT/CN2019/123932, dated Mar. 13, 2020.
CN Second Office Action in Application No. 201910009444.4, dated Oct. 21, 2020.

* cited by examiner

PIXEL-DRIVING CIRCUIT AND METHOD, AND A DISPLAY UTILIZING THE SAME

CROSS-REFERENCE TO RELATED APPLICATIONS

The present application is a national stage of International Application No. PCT/CN2019/123932 filed on Dec. 9, 2019, which claims priority to Chinese Patent Application No. 201910009444.4 filed on Jan. 4, 2019. The disclosures of these applications are hereby incorporated by reference in their entirety.

FIELD

The present disclosure relates generally to the field of display technology, and more specifically to a pixel-driving circuit, a pixel-driving method, and a display panel.

BACKGROUND

Organic Light-Emitting Diode (OLED) display is one of the hot topics in the field of display technologies. Compared with liquid-crystal displays (LCD), OLED can have the advantage of low energy consumption, low production costs, self-illuminating, wide-viewing angle and rapid response speed.

SUMMARY

Various embodiments of the present disclosure can provide a pixel-driving circuit, a driving method thereof, and a display panel In a first aspect, a pixel-driving circuit can be provided, including:

a reset sub-circuit;

a write-compensation sub-circuit;

a light-emission control sub-circuit; and a driving sub-circuit having a driving transistor, wherein:

the write-compensation sub-circuit is operatively connected to a signal scanning terminal, a data terminal, and the driving sub-circuit; and is configured to provide voltages of the data terminal to the driving sub-circuit, controlled with voltage from the signal scanning terminal, so as to compensate the driving sub-circuit;

the light-emission control sub-circuit is operatively connected to a light-emission control terminal, a first power source terminal, and the driving sub-circuit; and is configured to provide voltages of the first power source terminal to a first terminal of the driving transistor, controlled with voltage from the light-emission control terminal, during a first initialization phase and a light-emitting phase of an image frame;

the driving sub-circuit is further operatively connected to the first power source terminal;

the reset sub-circuit is operatively connected to a reset terminal, the initial voltage terminal, and the driving sub-circuit, wherein the reset sub-circuit is configured to provide voltages of the initial voltage terminal to a gate of the driving transistor, controlled with voltage from the reset terminal, during the first and the second initialization phases of the image frame, so as to cause the driving transistor to be in an ON state during the first initialization phase and in an OFF state during the second initialization phase.

In some embodiments:

the reset sub-circuit is further operatively connected to the signal scanning terminal; and the reset sub-circuit is configured to provide voltages of the initial voltage terminal to the gate of the driving transistor, controlled with voltages from the power source terminal and the signal scanning terminal, during the first and second phase of initialization so as to cause the driving transistor to be in an ON state during the first phase of initialization and in an OFF state during the second phase of initialization.

In some embodiments, the pixel-driving circuit further includes a light-emitting element, and wherein:

the light-emitting element is driven by the driving sub-circuit to emit light;

the light-emitting element is operatively connected to the second power source terminal;

the reset sub-circuit is further operatively connected to the light-emitting element, and is configured to provide voltages of the initial voltage terminal to the light-emitting element during the first and the second initialization phases of the image frame so as to cause reset of the light-emitting element and cause the driving sub-circuit to operatively connect with the light-emitting element during the light-emitting phase under voltage control of the signal scanning terminal.

In some embodiments, the reset sub-circuit includes transistors T1 and T3, and wherein:

a gate of T1 is operatively connected to the reset terminal, the first terminal of T1 is operatively connected to the initial voltage terminal, the second terminal of T1 is operatively connected to a first terminal of T3 and a second terminal of the driving transistor;

a gate of T3 is operatively connected to the reset terminal, a second terminal of T3 is operatively connected to the gate of the driving transistor.

In some embodiments, the reset sub-circuit includes transistors T1, T2, and T3, and wherein;

a gate of T1 is operatively connected to the reset terminal, a first terminal of T1 is operatively connected to the initial voltage terminal, a second terminal of T1 is operatively connected to a first terminal of T2;

a gate of T2 is operatively connected to the reset terminal, a second terminal of T2 is operatively connected to a second terminal of the driving transistor; and a gate of T3 is operatively connected to the reset terminal, a first terminal of T3 is operatively connected to the second terminal of T2, a second terminal of T3 is operatively connected to the gate of the driving transistor.

In some embodiments, the write-compensation sub-circuit includes a transistor T4, and wherein:

a gate of T4 is operatively connected to the reset terminal;

a first terminal of T4 is operatively connected to the data terminal; and a second terminal of T4 is operatively connected to the gate of the driving transistor.

In some embodiments, the light-emission control sub-circuit include a transistor T5, and wherein:

a gate of T5 is operatively connected to the light-emission control terminal;

a first terminal of T5 is operatively connected to the first power source terminal; and a second terminal of T5 is operatively connected to the driving sub-circuit.

In some embodiments, the driving sub-circuit further includes capacitors C1 and C2, and wherein:

a first terminal of C1 is operatively connected to the first power source terminal;

a second terminal of C1 is operatively connected to the first terminal of the driving transistor;

a first terminal of C2 is operatively connected to the gate of the driving transistor; and a second terminal of C2 is operatively connected to the first terminal of the driving transistor and the light-emission control sub-circuit.

In some embodiments, T2 is an N-type metal oxide semiconductor (NMOS) thin-film transistor (TFT); and T1, the driving transistor, T3, T4, and T5 are P-type metal oxide semiconductor (PMOS) TFTs.

In some embodiments, a voltage from the initial voltage terminal is applied to the gate of the driving transistor during the first initialization phase, and a threshold-compensated voltage from the initial voltage terminal is applied to the gate of the driving transistor during the second initialization phase, to thereby reduce IR drop from the first power source terminal and threshold voltage shifting of the driving transistor.

In another aspect, a display panel is provided, including a plurality of pixel elements, wherein each pixel element includes the pixel-driving circuit as described above.

In some embodiments, the pixel-driving circuit includes a light-emitting element, and the light-emitting element is an organic light-emitting diode (OLED).

In another aspect, a display apparatus is provided including the display panel described above, and a processor configured to:

during the first initialization phase of the image frame, place the driving transistor to be in an ON state by:

providing, with the light-emission control sub-circuit, voltage of the first power source terminal, to the first terminal of the driving transistor, controlled with voltage from the light-emission terminal;

providing, with the reset sub-circuit, voltage of the initial voltage terminal to the gate of the driving transistor, controlled with voltage from the reset signal terminal;

during the second initialization phase of the image frame, placing the driving transistor in an OFF state by:

providing, with the reset sub-circuit, voltage of the initial voltage terminal to the gate of the driving transistor, controlled with voltage from the reset terminal, during the writing phase of the image frame, compensate the driving sub-circuit by:

providing, with the write-compensation sub-circuit, voltage of the data terminal to the driving sub-circuit, controlled with voltage from the signal scanning terminal, during the light-emitting phase of the image frame, drive the light-emitting element to emit light by:

providing, with the light-emission control sub-circuit, voltage of the first power source terminal to the driving sub-circuit, controlled with voltage from the light-emission control terminal so as to cause the driving sub-circuit to drive the light-emitting element to emit light.

In some embodiments, the display apparatus further includes a non-transitory computer-readable storage medium having instructions stored thereon for execution by the processor to control the pixel-driving circuit.

In some embodiments, the display apparatus is one of a smart TV, a computer, a smart phone, or a tablet computer.

In some embodiments, regardless of the data voltage of a previous image frame, the driving transistor is subjected to data voltage writing and threshold voltage compensation from a same state, thereby reducing or eliminating temporary afterimage problem caused by a hysteresis effect, and a threshold voltage drift problem that impacts brightness uniformity of the display panel.

In another aspect, a method of driving the pixel-driving circuit is provided, the method including:

during the first initialization phase of the image frame, placing the driving transistor to be in an ON state by:

proving, with the light-emission control sub-circuit, voltage of the first power source terminal to the first terminal of the driving transistor, controlled with voltage from the light-emission terminal;

providing, with the reset sub-circuit, voltage of the initial voltage terminal to the gate of the driving transistor, controlled with voltage from the reset signal terminal;

during the second initialization phase of the image frame, placing the driving transistor in an OFF state by:

providing, with the reset sub-circuit, voltage of the initial voltage terminal to the gate of the driving transistor, controlled with voltage from the reset terminal, during the writing phase of the image frame, compensating the driving sub-circuit by:

providing, with the write-compensation sub-circuit, voltage of the data terminal to the driving sub-circuit, controlled with voltage from the signal scanning terminal, during the light-emitting phase of the image frame, driving the light-emitting element to emit light by:

providing, with the light-emission control sub-circuit, voltage of the first power source terminal to the driving sub-circuit, controlled with voltage from the light-emission control terminal so as to cause the driving sub-circuit to drive the light-emitting element to emit light.

In some embodiments:

the providing, with the reset sub-circuit, voltage during the first initialization phase is further controlled with voltage from the reset signal terminal and the signal scanning terminal;

the providing, with the reset sub-circuit, voltage during the second initialization phase is further controlled with voltage from the reset signal terminal and the signal scanning terminal.

In some embodiments, the reset sub-circuit is further connected to the light-emitting element, the method further including:

during the first and the second initialization phases of the image frame, resetting the light-emitting element by having the reset sub-circuit to provide voltages of the initial voltage terminal to the light-emitting element.

In another aspect, a non-transitory computer-readable storage medium is provided, having instructions stored thereon for execution by a processing circuit to realize the method described above.

It should be noted that the above general description and the following detailed description are merely exemplary and explanatory and should not be construed as limiting of the present disclosure.

Other embodiments may become apparent in view of the following descriptions and the attached drawings.

BRIEF DESCRIPTION OF THE DRAWINGS

To more clearly illustrate some of the embodiments, the following is a brief description of the drawings. The drawings in the following descriptions are only illustrative of some embodiments. For those of ordinary skill in the art, other drawings of other embodiments can become apparent according to these drawings.

DETAILED DESCRIPTION

Figure 1A:
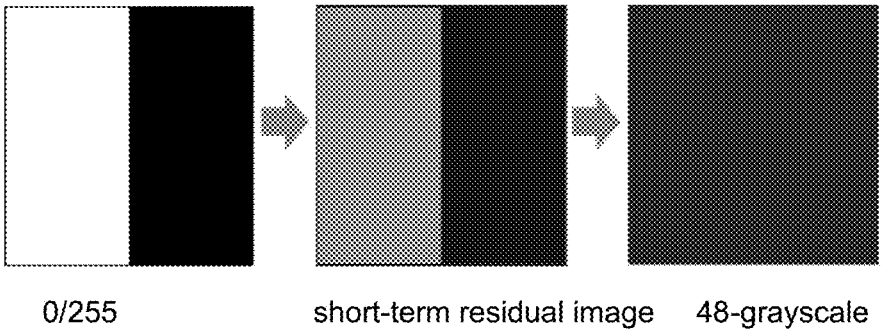
FIG. 1A illustrates a short-term residual image effect exhibited by a conventional display.

In the following, with reference to the drawings of various embodiments disclosed herein, the technical solutions of the embodiments of the disclosure will be described in a clear and fully understandable way.

It will be understood that, although the terms first, second, etc. can be used herein to describe various elements, these elements should not be limited by these terms. These terms are only used to distinguish one element from another.

For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or other structure is referred to as being "on" or extending "onto" another element, it can be directly on or extend directly onto the other element or intervening elements can also be present. In contrast, when an element is referred to as being "directly on" or extending "directly onto" another element, there are no intervening elements present.

Likewise, it will be understood that when an element such as a layer, region, or substrate is referred to as being "over" or extending "over" another element, it can be directly over or extend directly over the other element or intervening elements can also be present.

In contrast, when an element is referred to as being "directly over" or extending "directly over" another element, there are no intervening elements present.

It will also be understood that when an element is referred to as being "connected" or "coupled" to another element, it can be directly connected or coupled to the other element or intervening elements can be present. In contrast, when an element is referred to as being "directly connected" or "directly coupled" to another element, there are no intervening elements present.

Relative terms such as "below" or "above" or "upper" or "lower" or "horizontal" or "horizontal" can be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs.

It will be further understood that terms used herein should be interpreted as having a meaning that is consistent with their meaning in the context of this specification and the relevant art and will not be interpreted in an idealized or overly formal sense unless expressly so defined herein.

The inventors of the present disclosure have recognized that conventional OLED displays suffer from the temporary afterimage phenomenon which has been shown to be related to the hysteresis effect of the driving transistor in the OLED display.

For example, when an OLED screen switches to a 48-grayscale picture after displaying the black and white picture for a period of time, an afterimage will appear, and disappear after a short time, which is referred to as the short-term residual image, as shown in FIG. 1A.

For example, a typical OLED display, after switching to a 48-grayscale image after a 10-second display of a black and white screen, the short-term residual image may take 2-6 seconds to disappear.

Figure 1B:
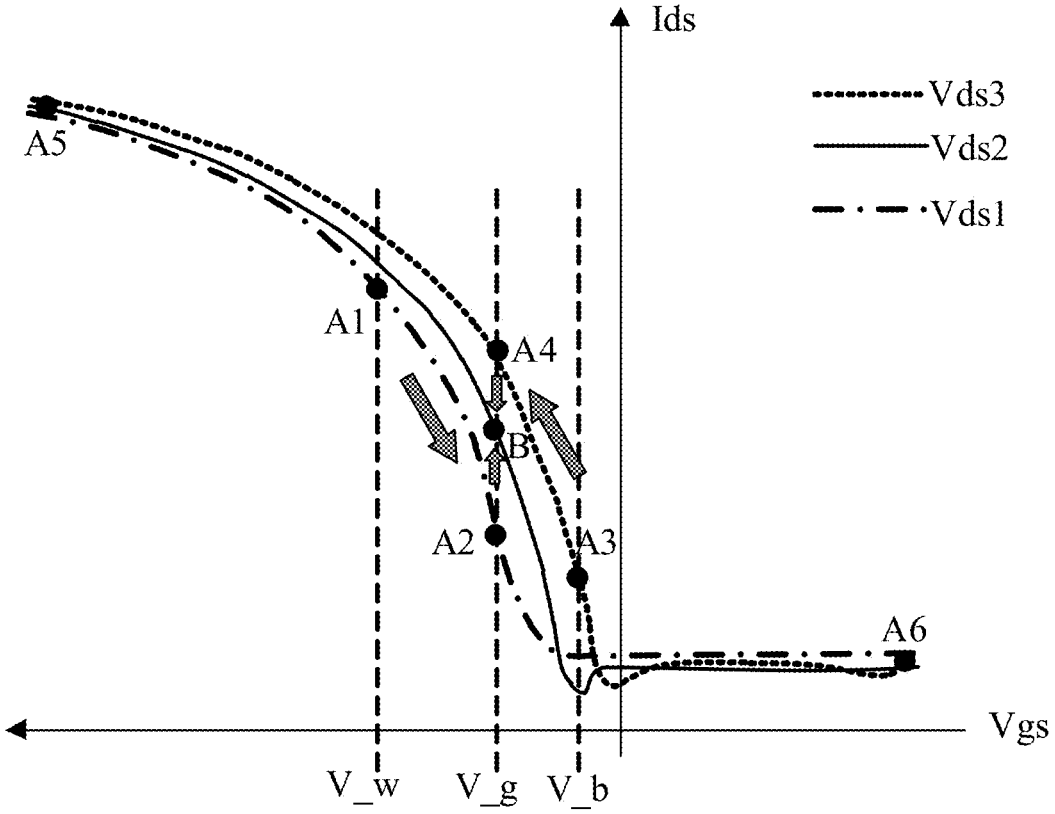
FIG. 1B illustrates the hysteresis effect exhibited by the conventional display.

This hysteresis effect is illustrated in FIG. 1B, where the dashed line in the figure shows the characteristic curve of the current Ids and source gate voltage ($V_{gs}$) of a transistor of a pixel-driver when the OLED display is showing the maximum gray level, when the subpixel driver transistor's source voltage leakage is Vds1.

Dotted line is the characteristic curve of the current Ids and source gate voltage $V_{gs}$ of a transistor of a pixel-driver when the display is showing the minimum gray level and the source voltage leakage is Vds3.

Solid line is the characteristic curve of the current Ids and source gate voltage $V_{gs}$ of a transistor of a pixel-driver when the display is showing the intermediate gray level and the source voltage leakage is Vds2.

Figure 1C:
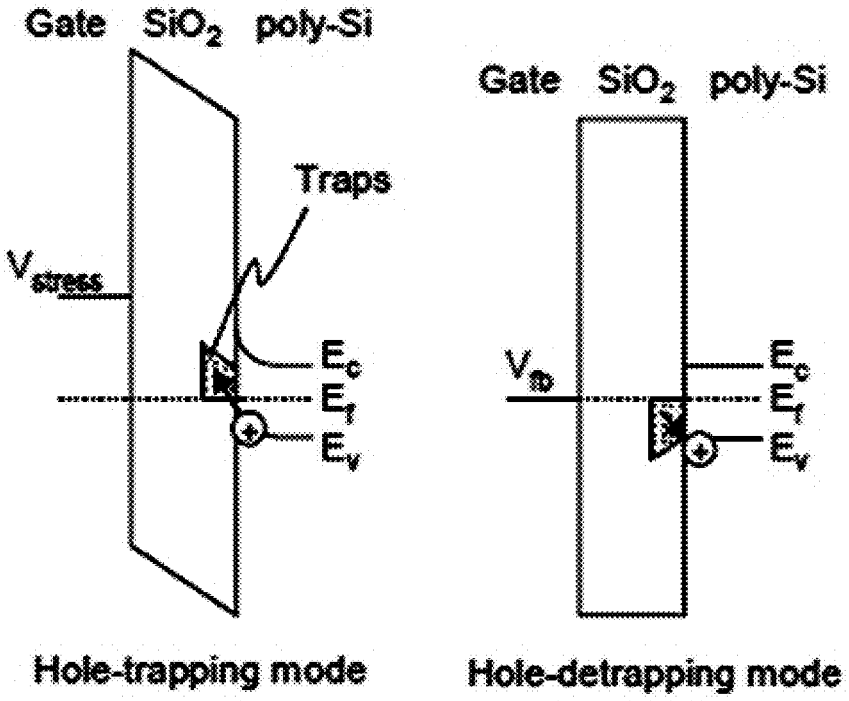
FIG. 1C illustrates the hole-trapping and hole-detrapping modes causing the hysteresis effect in FIG. 1B.

When a display switches from a maximum gray level (e.g., 0/255) to an intermediate gray level (e.g., 0/48), the driving current Ids in the sub-pixel needs to be reduced when the maximum gray level is displayed, as the semiconductor layer and the gate insulating layer interface of the driving transistor in this sub-pixel need to perform charge release (hole detrapping; see, FIG. 1C), from point A1 to point to A2.

At this time, the $V_{gs}$ value changes from V_w to V_g. When a display switches from minimum gray level to grayscale picture, the driving current Ids of the driving transistor in the sub-pixel needs to be increased when the minimum gray level is displayed. As such, the semiconductor layer and the gate insulating layer interface of the driving transistor in the sub-pixel need to perform charge trapping (Hole Trapping; see, FIG. 1C) from point A3 to point A4, and the $V_{gs}$ value changes from V_b to V_g.

It can be seen that during the process of charge trapping and discharging, the paths of voltage changes are different, the driving current Ids corresponding to point A2 and point A4 by which the voltage V_g reaching different paths are different. This leads to a difference in luminance between the sub-pixel that switches from maximum gray level to grayscale picture and the sub-pixel that switches from minimum gray level to grayscale picture, thereby, creating the temporary afterimage.

After being left alone for a period of time, the above points A2 and A4 both reaches the point B, and the afterimage disappears.

Figure 1D:
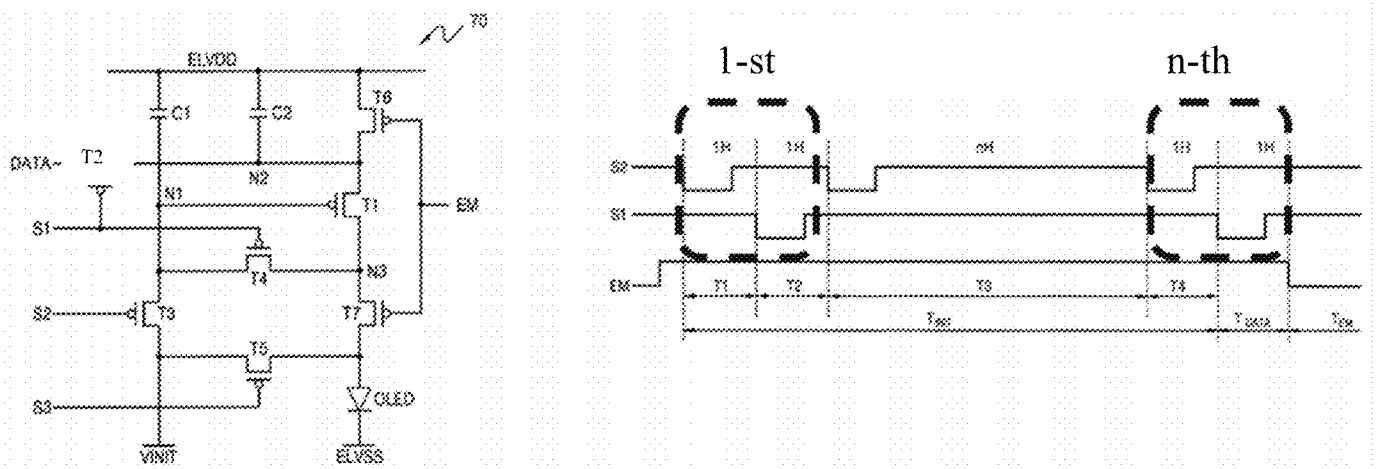
FIG. 1D illustrates an existing approach to tackle the short-term residual image effect.

An existing approach is illustrated in FIG. 1D, where a circuit 70 is adopted to perform charging and discharging operation of the TFT for a number of times (e.g., from the 1-st to the n-th cycle) in the initial stage, and the display is not turned on during the process to emit light. After the TFT is stabilized, the display is turned on to emit light, thereby improving the short-term residual image problem.

Various embodiments of the present disclosure can provide display apparatus that do not suffer from the temporary afterimage problems of conventional displays, and can address the problems in which the brightness uniformity of a display device is affected by threshold voltage drift.

Figure 2A:
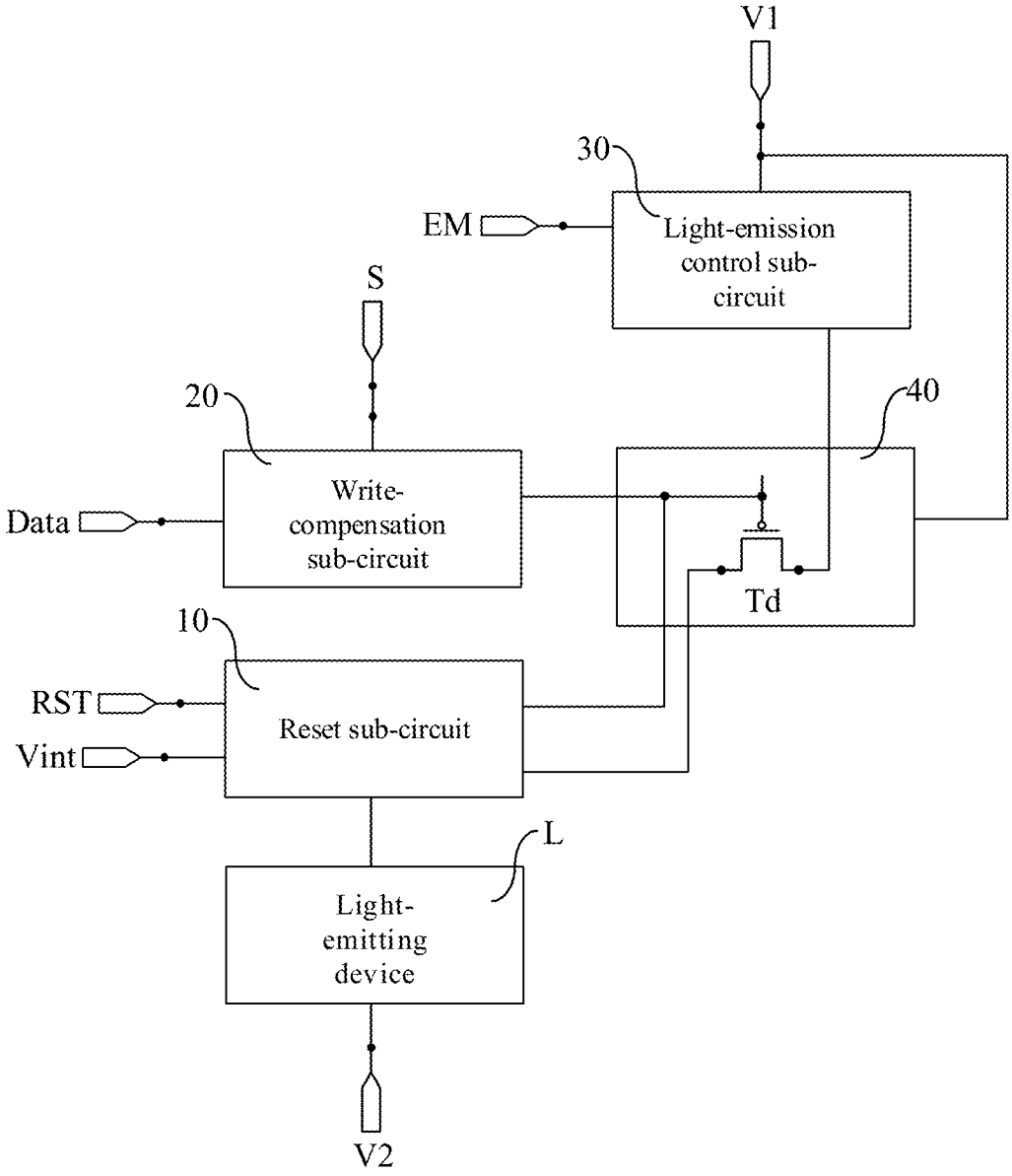
FIG. 2A shows a schematic of an exemplary pixel-driving circuit in accordance with embodiments of the present disclosure.

In an aspect, embodiments of the present disclosure provide a pixel-driving circuit, as exemplified in FIG. 2A.

Referring to FIG. 2A, the circuit has a reset sub-circuit 10, a write-compensation sub-circuit 20, a light-emission control sub-circuit 30, and a driving sub-circuit 40, wherein the driving sub-circuit 40 includes a driving transistor Td.

The write-compensation sub-circuit 20 is operatively connected to the signal scanning terminal S, the data terminal Data, and the driving sub-circuit 40. The write-compensation sub-circuit 20 is configured to provide the data voltage outputted by the data terminal Data to the driving sub-circuit 40 controlled with voltage from the signal scanning terminal S and compensate the driving sub-circuit 40.

The transistors described herein generally include a gate, a first terminal, and a second terminal. The phrase "controlled with voltage from a terminal" can indicate that the operative state of a circuit is determined by the voltage of the terminal.

The light-emission control sub-circuit 30 is operatively connected to the light-emission control terminal EM, the first power source terminal V1, and the driving sub-circuit 40. The light-emission control sub-circuit 30 is configured to provide voltages of the first power source terminal V1 to the first terminal of the driving transistor Td during the first initialization phase and the light-emitting phase of an image frame controlled with voltage from the light-emission control terminal EM.

The driving sub-circuit 40 is also operatively connected to the first power source terminal V1. The driving sub-circuit 40 is configured to drive the light emitting device L to emit light during the light emitting phase.

In the above embodiments, the driving transistor Td has two terminals and a gate, the first terminal is the source terminal while the second terminal is the drain terminal.

In some embodiments, the driving transistor Td comprises a thin-film transistor (TFT), such as a P-type metal oxide semiconductor (PMOS) TFT.

The various device components, circuits, sub-circuits, modules, units, blocks, or portions may have modular configurations, or are composed of discrete components, but nonetheless may be referred to as "modules," "units," "circuits" or "sub-circuits" in general. In other words, the "components," "circuits," "modules," "units," "blocks," or "portions" referred to herein may or may not be in modular forms.

The reset sub-circuit 10 can be operatively connected to the reset signal terminal RST, the initial voltage terminal $V_{int}$, and the drive sub-circuit 40. The reset sub-circuit 10 can be configured to provide voltages from the initial voltage terminal $V_{int}$ to the driving transistor Td during the first and the second initialization phases of an image frame controlled with voltage from the reset signal terminal RST such that the driving transistor Td is in an ON state during the first initialization phase and is in an OFF state during the second initialization phase of an image frame.

It will be understood that the above mentioned first phase and the second phase of image frame initialization refer to the initialization phases of an image frame during which the afterimage of the previous frame is eliminated.

Consider the example of switching from maximum gray level picture or minimum gray level picture to the intermediate gray level picture in view of FIG. 1, it can be seen that during the first phase of initialization, by placing the driving transistor Td in all of the driving-circuits of all pixels of a display panel in an ON state (On-bias), the $V_{gs}$ of the driving transistor Td at this time will be found at the uppermost end of the characteristic curve (corresponding to point A5 in FIG. 1), wherein the corresponding current Ids is large.

That is, for a sub-pixel displaying the maximum gray level, it will reach the vicinity of point A5 from point A1, and for a sub-pixel displaying minimum gray level, it will reach the vicinity of point A5 from point A3. The charge trapping state is approximately the same for all sub-pixel driving transistors Td.

In the second initialization phase, by making all the driving transistors Td in the pixel-driving circuits of each sub-pixel of the display panel to be in an OFF state (OFF-Bias), the $V_{gs}$ of the driving transistor Td are found at the lowermost part of the characteristic curve (corresponding to the vicinity of point A6 in FIG. 1), wherein the corresponding current Ids is small.

That is, for sub-pixels displaying maximum gray level and minimum gray level, they will all reach the vicinity of point A6 from the vicinity of point A5, and the charge release states of the drive transistor Td are approximately the same in all the sub-pixels.

Because the driving transistor Td have different performance characteristics, the respective $V_{gs}$ of the driving transistor Td may be different when the ON state (ON-Bias) or the OFF state (OFF-Bias) is reached.

Therefore, in some embodiments of the present disclosure, it is discovered that the problem of afterimage will be better resolved by allowing the transistor to reach ON-Bias first and then OFF-Bias so as to ensure all driving transistors Td in all the sub-pixels are in the same state.

Based on the above, when the next image frame is displayed, the current Ids of the driving transistor Td in each sub-pixel needs to be increased. Therefore, the semiconductor layer and the gate insulating layer interface of the driving transistor Td in each sub-pixel need to perform charge acquisition (hole trapping).

In such a case, the charge acquisition paths of the respective driving transistors Td are the same so that the temporary afterimage problem caused by the hysteresis effect can be alleviated, and the brightness can reach the level corresponding to point B, which is consistent with the brightness corresponding to the actual gray level.

In some embodiments, the writing-compensation sub-circuit 20 provides data voltages outputted by the data terminal Data to the driving sub-circuit 40 in the writing phase, and compensates the driving sub-circuit 40 to enable the driving sub-circuit.

When the light-emitting element L is driven to emit-light, the current flowing through the light-emitting element L is independent of the threshold voltage of the driving transistor Td, thereby eliminating the influence of the threshold voltage on the light-emitting luminance and improving display uniformity.

Further, by making the driving transistor Td in an ON state (ON-Bias) in the first phase of initialization, and in an OFF state (OFF-Bias) in the second phase of initialization, the effect of improving temporary afterimage is alleviated.

Therefore, regardless of the data voltage of the previous frame, the driving transistor Td performs data voltage writing and threshold voltage compensation from the same state, thereby alleviating the temporary afterimage problem caused by the hysteresis effect as well as minimizing the impact that threshold voltage drift has on the brightness uniformity of the display.

Figure 2B:
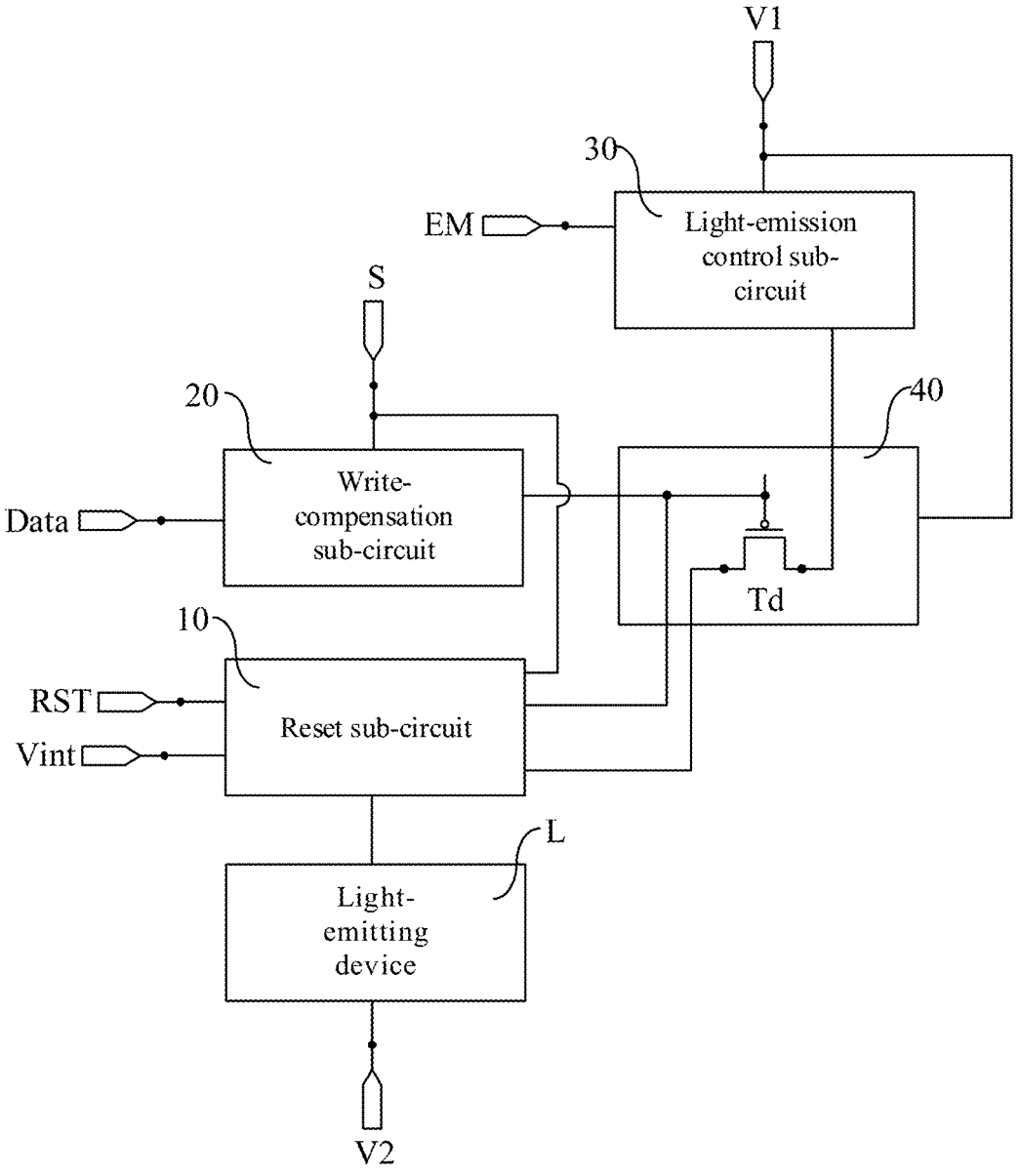
FIG. 2B shows a schematic of another exemplary pixel-driving circuit in accordance with embodiments of the present disclosure.

In some embodiments, as shown in FIG. 2B, the reset sub-circuit 10 is also operatively connected to the signal scanning terminal S.

In these embodiments, the reset sub-circuit 10 is configured to provide voltages of the initial voltage terminal $V_{int}$ to the gate of the driving transistor Td controlled with voltage from the reset signal terminal RST during the first and second initialization phases of the image frame so as to cause the driving transistor Td to be in an ON state during the first initialization phase and in an OFF state during the second initialization phase.

In these embodiments, the reset sub-circuit 10 is further configured to provide voltages of initial voltage terminal $V_{int}$ to the gate of the driving transistor Td controlled with voltage from the reset signal terminal RST and the signal scanning terminal S during the first and second initialization phases of the image frame, so as to cause the driving transistor Td to be in an ON state during the first initialization phase and in an OFF state during the second initialization phase.

Based on the above, in some other embodiments, the light emitting device L may also be operatively connected to the second power voltage terminal V2.

In these embodiments, the reset sub-circuit 10 is also operatively connected to the light-emitting element L. The reset sub-circuit 10 is further configured to provide voltages of the initial voltage terminal $V_{int}$ to the light-emitting element L during the first and the second initialization phases of an image frame, so as to reset the light-emitting element L; connecting the driving sub-circuit to the light-emitting element L controlled with voltage from the scanning signal terminal S.

Further, in the above embodiments, the reset sub-circuit 10 is operatively connected to the anode of the light-emitting element L, and the cathode of the light-emitting element L is connected to the second power source terminal V2.

The first power source terminal V1 may be a high-voltage terminal and output a constant high voltage; the second power source terminal V2 is a low-voltage terminal and output a constant low-voltage.

Here, "high" and "low" only indicate the relative magnitude relationship between the input voltages. The second power source terminal V2 can also be grounded.

Figure 3A:
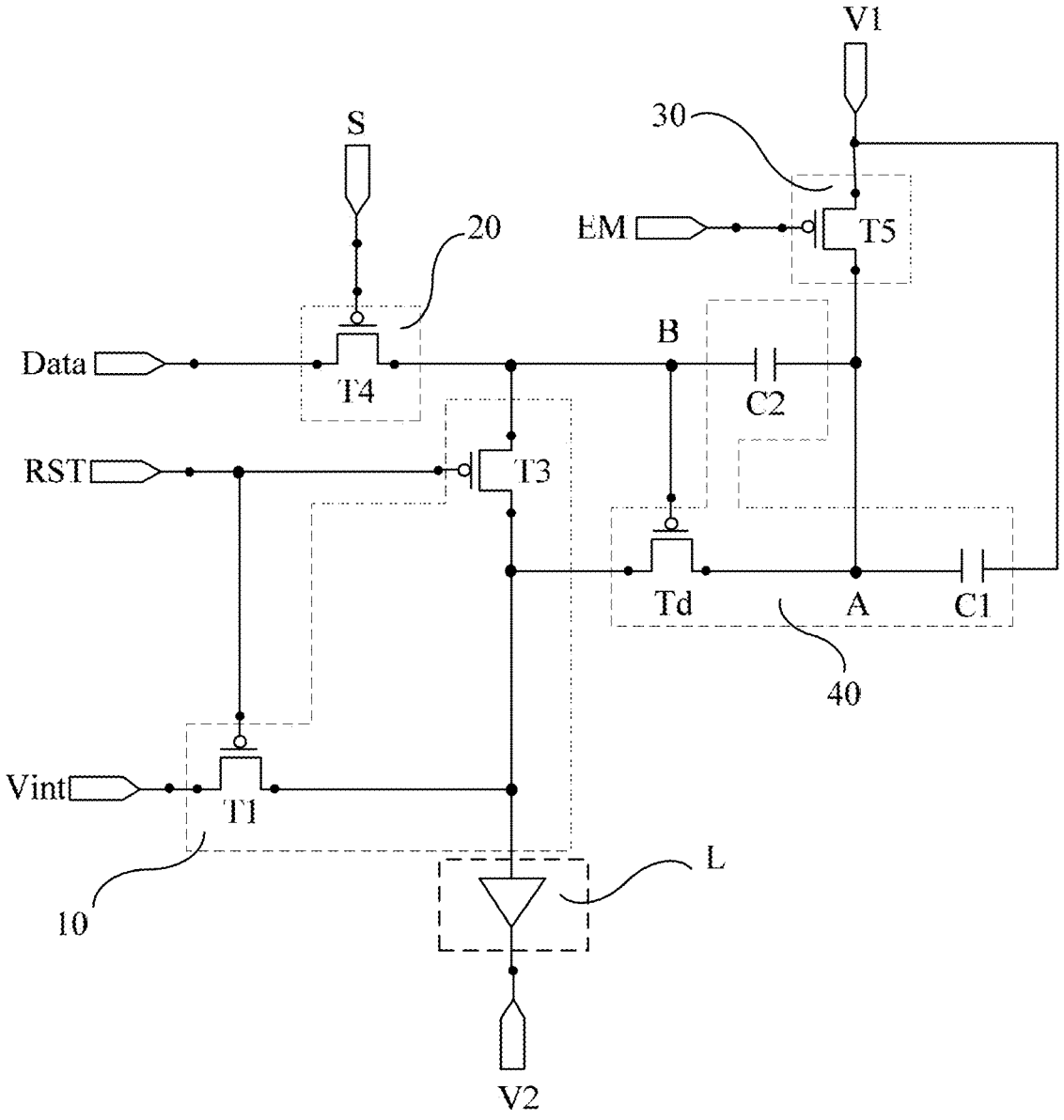
FIG. 3A illustrates specific structures of each sub-circuit of an exemplary pixel-driving circuit shown in FIG. 2A.

In some embodiments, as shown in FIG. 3A, the reset sub-circuit 10 includes transistors T1 and T3.

The gate of transistor T1 is operatively connected to the reset signal terminal RST, the first terminal is operatively connected to an initial voltage terminal $V_{int}$, and the second terminal is operatively connected to the first terminal of transistor T3 and the second terminal of the driving transistor Td.

The gate of transistor T3 is operatively connected to the reset signal terminal RST, and its second terminal is operatively connected to the gate of the driving transistor Td.

It should be noted that the reset sub-circuit 10 may further include a plurality of switching transistors operatively connected in parallel with the first transistor T1 and/or a plurality of switching transistors operatively connected in parallel with transistor T3.

The above is merely an example of the reset sub-circuit 10. Other structures having the same functions as those of the reset sub-circuit 10 and will not be further described herein. Such similar structures will be understood by those skilled in the art as fall within the scope of the present disclosure.

Figure 3B:
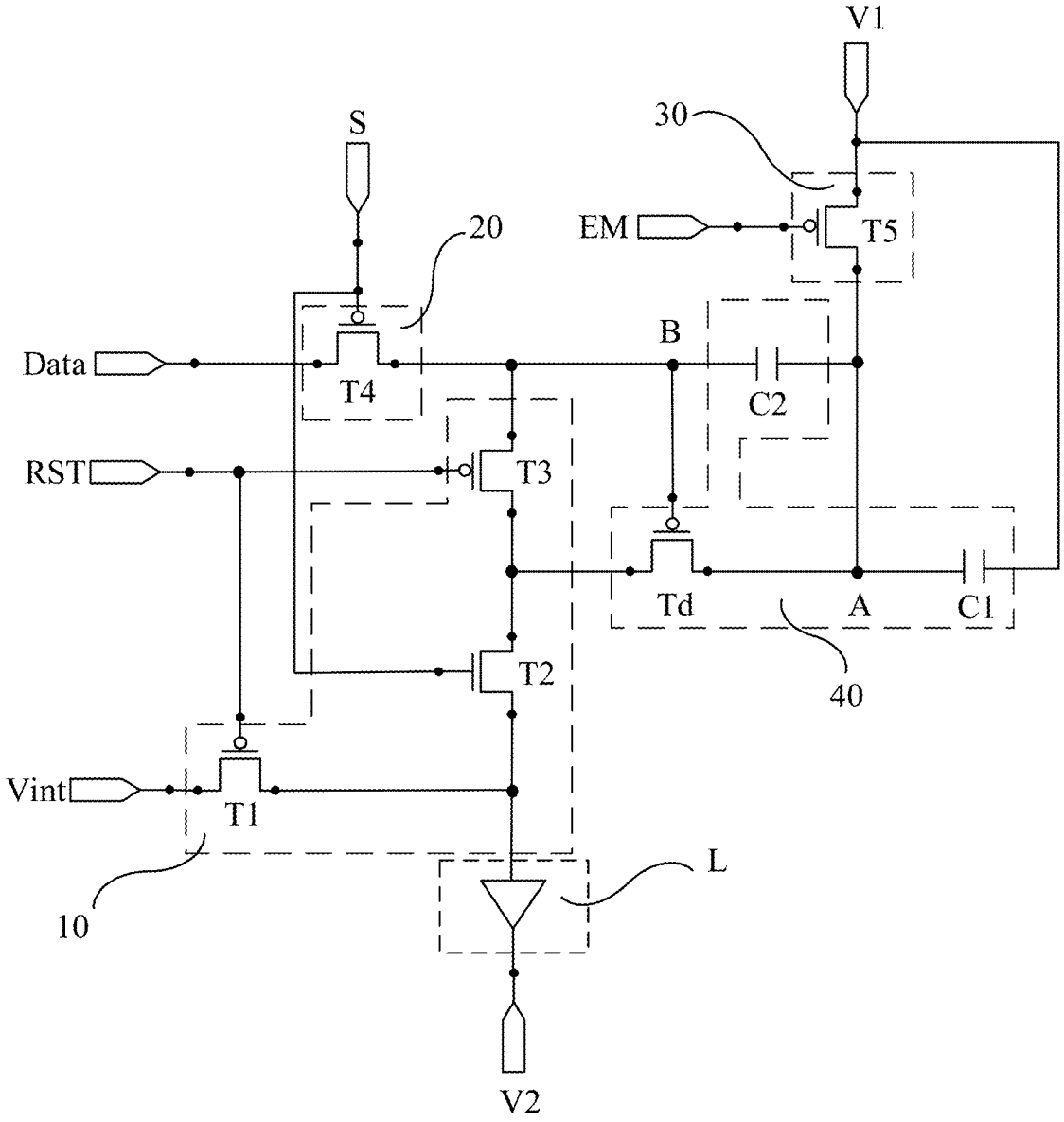
FIG. 3B shows a specific structural diagram of each sub-circuit of the exemplary pixel-driving circuit shown in FIG. 2B.

In some embodiments, as shown in FIG. 3B, the reset sub-circuit 10 includes transistors T1, T2, and T3.

The gate of transistor T1 is operatively connected to the reset signal terminal RST, its first terminal is operatively connected to the initial voltage terminal $V_{int}$, and its second terminal is operatively connected to the first terminal of transistor T2.

The gate of transistor T2 is operatively connected to the signal scanning terminal S, and its second terminal is operatively connected to the second terminal of the driving transistor Td.

The gate of transistor T3 is operatively connected to the reset signal terminal RST, and its first terminal is operatively connected to the second terminal of transistor T2, and its second terminal is operatively connected to the gate of the driving transistor Td.

Compared with the reset sub-circuit 10 of the embodiments shown in FIG. 3A, in which the reset sub-circuit 10 includes transistors T1, T2, and T3, in this embodiment (FIG. 3B), transistor T2 can be turned ON or OFF under the control of the signal scanning terminal S, thereby functioning as a switch.

It should be noted that the reset sub-circuit 10 may further include a plurality of switching transistors operatively connected in parallel with transistor T1, and/or a plurality of switching transistors operatively connected in parallel with transistor T2, and/or a plurality of switching transistors operatively connected in parallel with transistor T3.

The above is merely an example of the reset sub-circuit 10. Other structures having the same functions as those of the reset sub-circuit 10 will not be further described herein, but all should be understood as falling within the scope of the present disclosure.

Alternatively, as shown in FIGS. 3A and 3B, the write-compensation sub-circuit 20 includes transistor T4.

The gate of transistor T4 is operatively connected to the signal scanning terminal S, its first terminal is operatively connected to the data terminal Data, and its second terminal is operatively connected to the gate of the driving transistor Td.

It should be noted that the write-compensation sub-circuit 20 may further include a plurality of switching transistors connected in parallel with transistor T4. The foregoing is only an example of the write-compensation sub-circuit 20.

The other structures having the same functions as those of the write-compensation sub-circuit 20 are not described herein again, but all should be understood as falling within the scope of the present disclosure.

Alternatively, as shown in FIGS. 3A and 3B, the light-emission control sub-circuit 30 includes another transistor T5.

The gate of transistor T5 is operatively connected to the light-emission control terminal EM, the first terminal is operatively connected to the first power supply voltage terminal V1, and the second terminal is operatively connected to the driving sub-circuit 40.

It should be noted that the light-emission control sub-circuit 30 may further include a plurality of switching transistors operatively connected in parallel with the fifth transistor T5.

The foregoing is merely an illustration of the light-emission control sub-circuit 30.

Other structures having the same functions as those of the light-emission control sub-circuit 30 are not described herein again, but are understood as falling within the scope of the present disclosure.

In some embodiments, as shown in FIGS. 3A and 3B, the driving sub-circuit 40 includes capacitor C1 and capacitor C2 in addition to the driving transistor Td.

Capacitor C1 has a first terminal operatively connected to the first power voltage terminal V1, and a second terminal operatively connected to the first terminal of the driving transistor Td. Capacitor C2 has a first terminal operatively connected to the gate of the driving transistor Td, and a second terminal operatively connected to the first terminal of the driving transistor Td and the light-emission controlling sub-circuit 30.

In the above embodiments, the light-emission control sub-circuit 30 includes transistor T5 described above, wherein the second terminal of capacitor C2 is coupled to the second terminal of transistor T5.

In some embodiments, as shown in FIG. 3A, the anode of the light-emitting element L is operatively connected to at least the reset sub-circuit 10, and the cathode is operatively connected to the second power source terminal V2.

In the case where the reset sub-circuit 10 includes transistor T1 and transistor T3, excluding transistor T2, the second terminal of transistor T1 is operatively connected to the anode of the light-emitting element L. On this basis, the anode of the light-emitting element L is also connected to the second terminal of the driving transistor Td.

Based on the above, as shown in FIG. 3B, in the case where the reset sub-circuit 10 includes transistors T1, T2 and T3, the second terminal of T1 and first terminal of T2 are all operatively connected to the anode of the light-emitting element L.

Based on the above description of each sub-circuit, and with reference to the illustration shown in FIG. 3A, the specific driving process of the above pixel-driving circuit will be described in detail below.

In the above description, transistor T1, T3, T4, T5, and the driving transistor Td are all P-type transistors.

Figure 4:
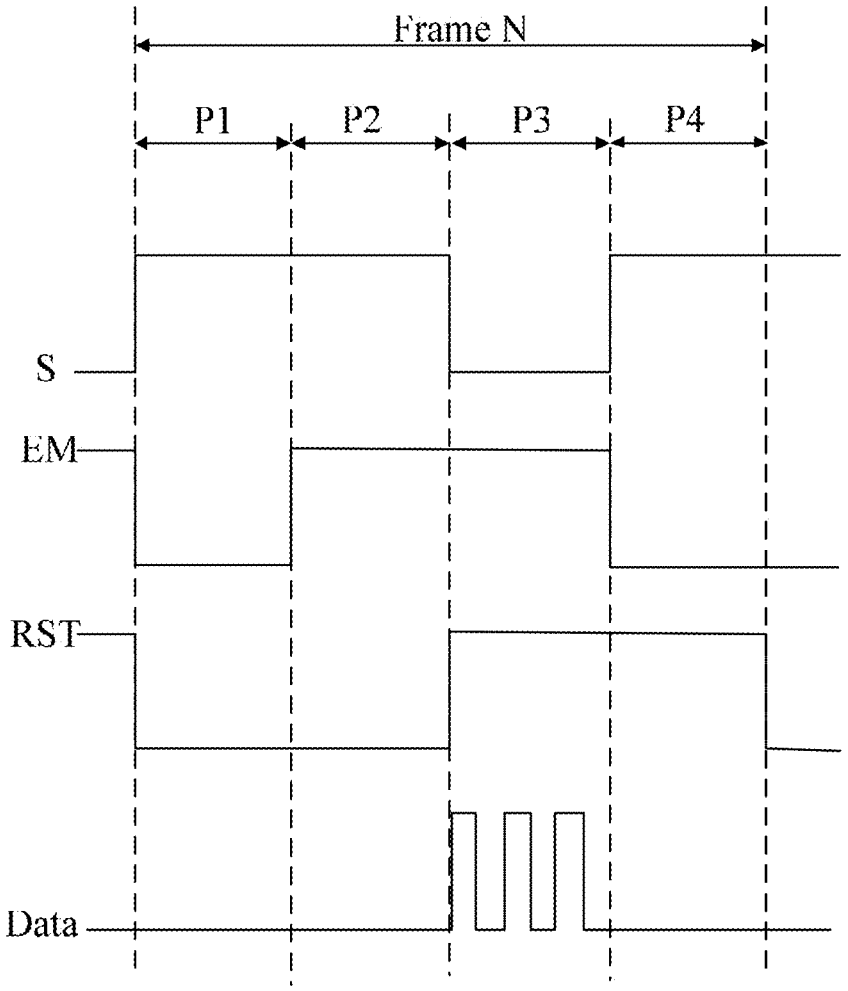
FIG. 4 is a swim lane diagram showing the actions of each sub-circuit of the pixel-driving circuit shown in FIGS. 2A and 2B throughout the four phases of an image frame.

As shown in FIG. 4, each frame display process of the pixel circuit can be divided into an initial phase P1 and a second phase P2, an input compensation phase P3, and a light-emitting phase P4.

Figure 5A:
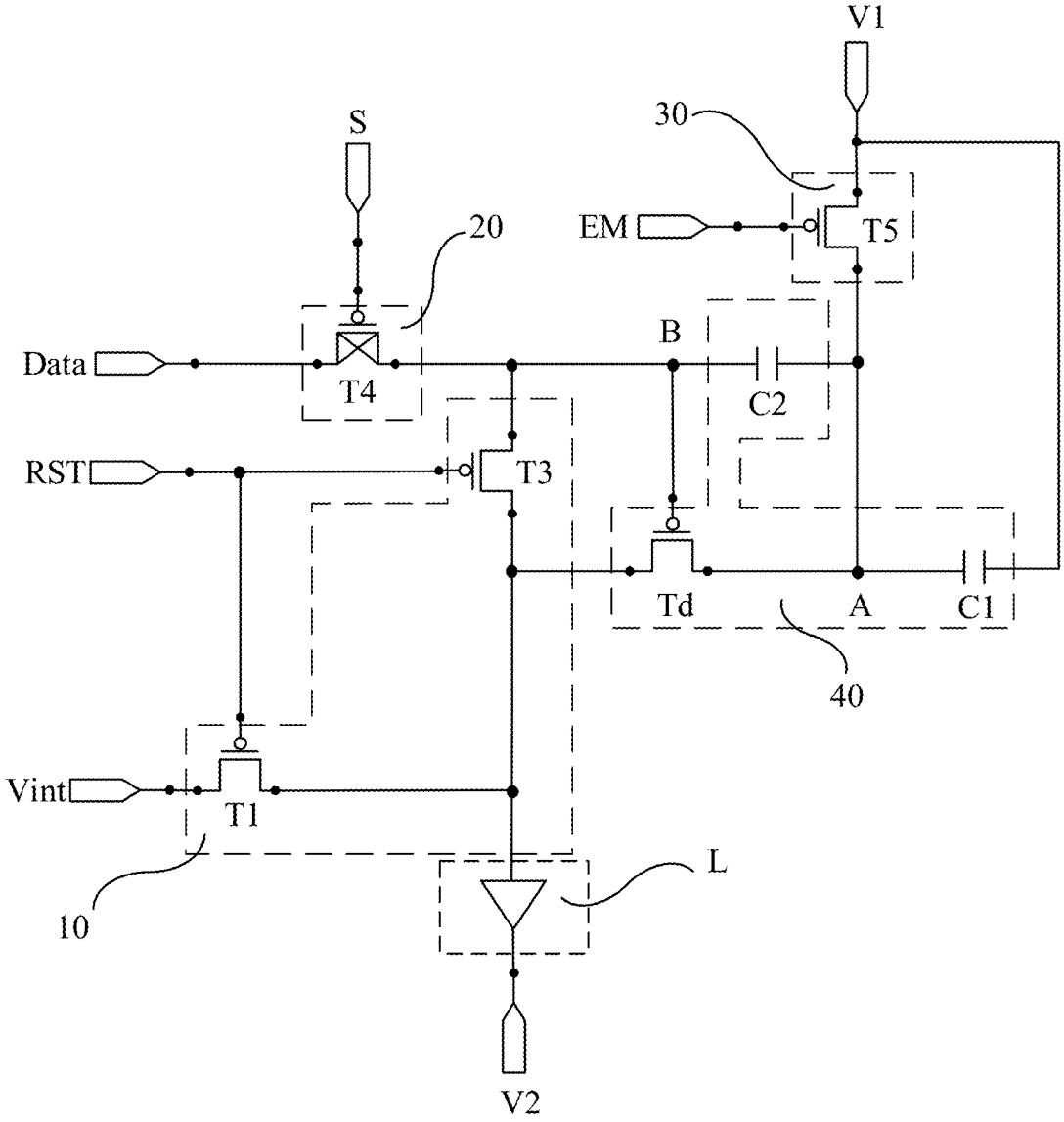
FIG. 5A is an equivalent circuit diagram of the pixel-driving circuits shown in FIG. 3A at a first phase of an image frame.

In the initial phase P1 of image frame initialization, the reset signal terminal RST and the light-emission control terminal EM output a low-level signal, and the signal scanning terminal S outputs a high-level signal. Based on this, the equivalent circuit diagram of the pixel-driving circuit shown in FIG. 3A is as shown in FIG. 5A. Here transistor T1, T3, and T5 are all turned ON, and transistor T4 is turned OFF.

Transistors T1 and T3 are turned ON so that the voltage of the initial voltage terminal $V_{int}$ (referred to as $V_0$) is inputted to the gate of the driving transistor Td; transistor T5 is turned ON so that voltage at the first power voltage terminal V1 (at this time, the voltage is denoted as $V_{dd}$) is input to the first terminal of the driving transistor Td such that Td has $V_{gs}=V_0-V_{dd}<-|V_{th}|$, and is in an ON state (ON-Bias).

Figure 5B:
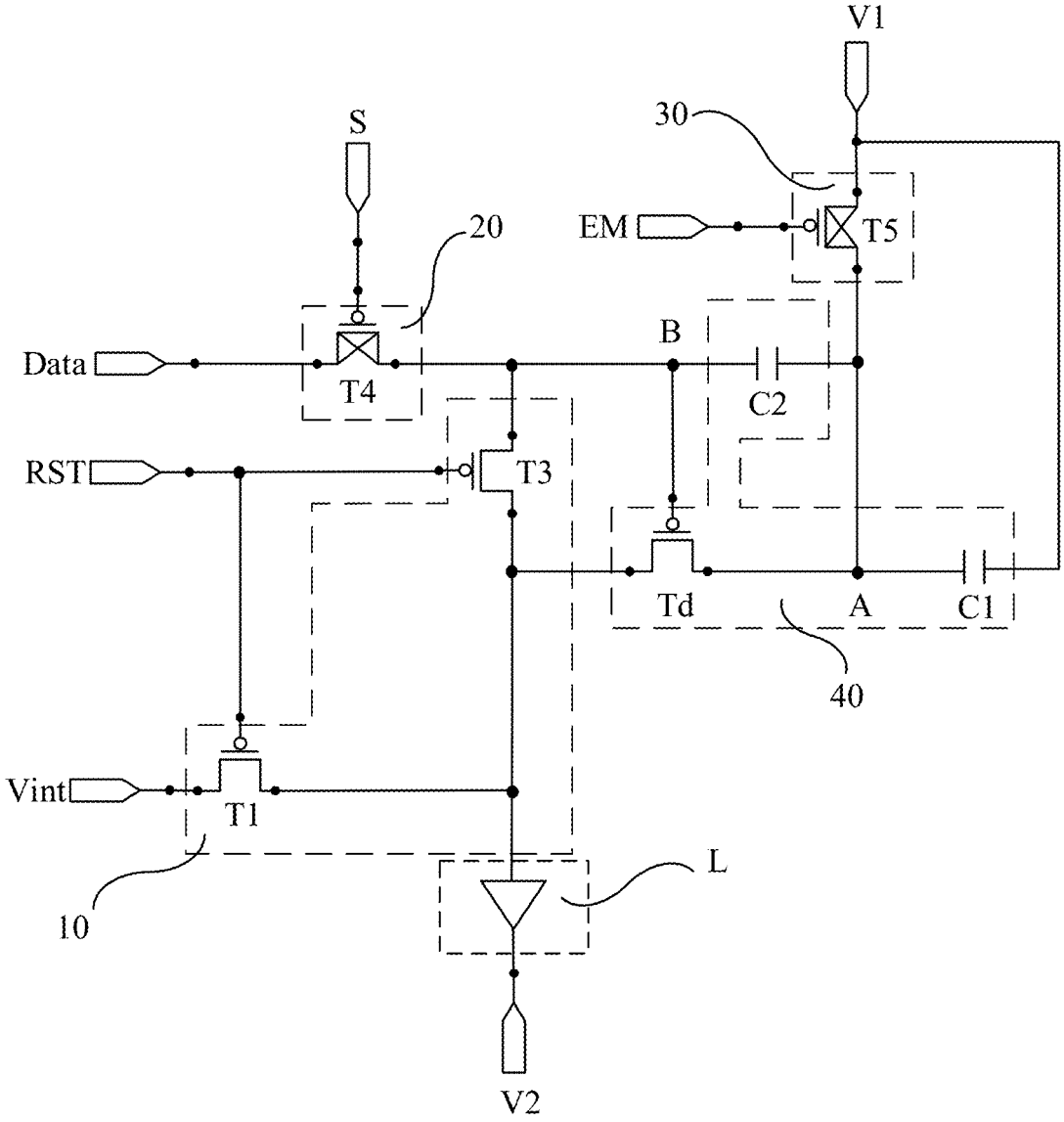
FIG. 5B is an equivalent circuit diagram of the pixel-driving circuits shown in FIG. 3A at a second phase of an image frame.

In the second phase of initialization P2, the reset signal terminal RST outputs a low-level signal, and the signal scanning terminal S and the light-emission control terminal EM output a high-level signal. Based on this, the equivalent circuit diagram of the pixel circuit shown in FIG. 3A is as shown in FIG. 5B. Here transistor T1 and T3 are both turned ON, and transistor T4 and T5 are both turned OFF.

Transistor T1 and T3 are turned on so as to cause the voltage ($V_0$) of the initial voltage terminal $V_{int}$ to be inputted to the gate of the driving transistor Td; and transistor T5 is turned OFF so as to cause the voltage of the first terminal of the driving transistor Td to drop (at point A in FIG. 5B) until the driving transistor Td is turned OFF, at which time the voltage of the first terminal of the driving transistor Td reaches $V_0+|V_{th}|$, and therefore, the driving transistor Td has $V_{gs}=V_0-(V_0+|V_{th}|)=-|V_{th}|$, subsequently causing the driving transistor Td to be in an off state (OFF-Bias).

After initialization, all driving transistors Td are in the same state in the pixel-driving circuits of all the sub-pixels of the display panel.

Therefore, regardless of the data voltage of the previous frame, the driving transistor Td performs data voltage writing and threshold voltage compensation from the same state, thereby alleviating the short-term afterimage problem caused by the hysteresis effect.

In the write-compensation phase P3, the signal scanning terminal S outputs a low-level signal, and the reset signal terminal RST and the light-emission control terminal EM output a high-level signal.

Figure 5C:
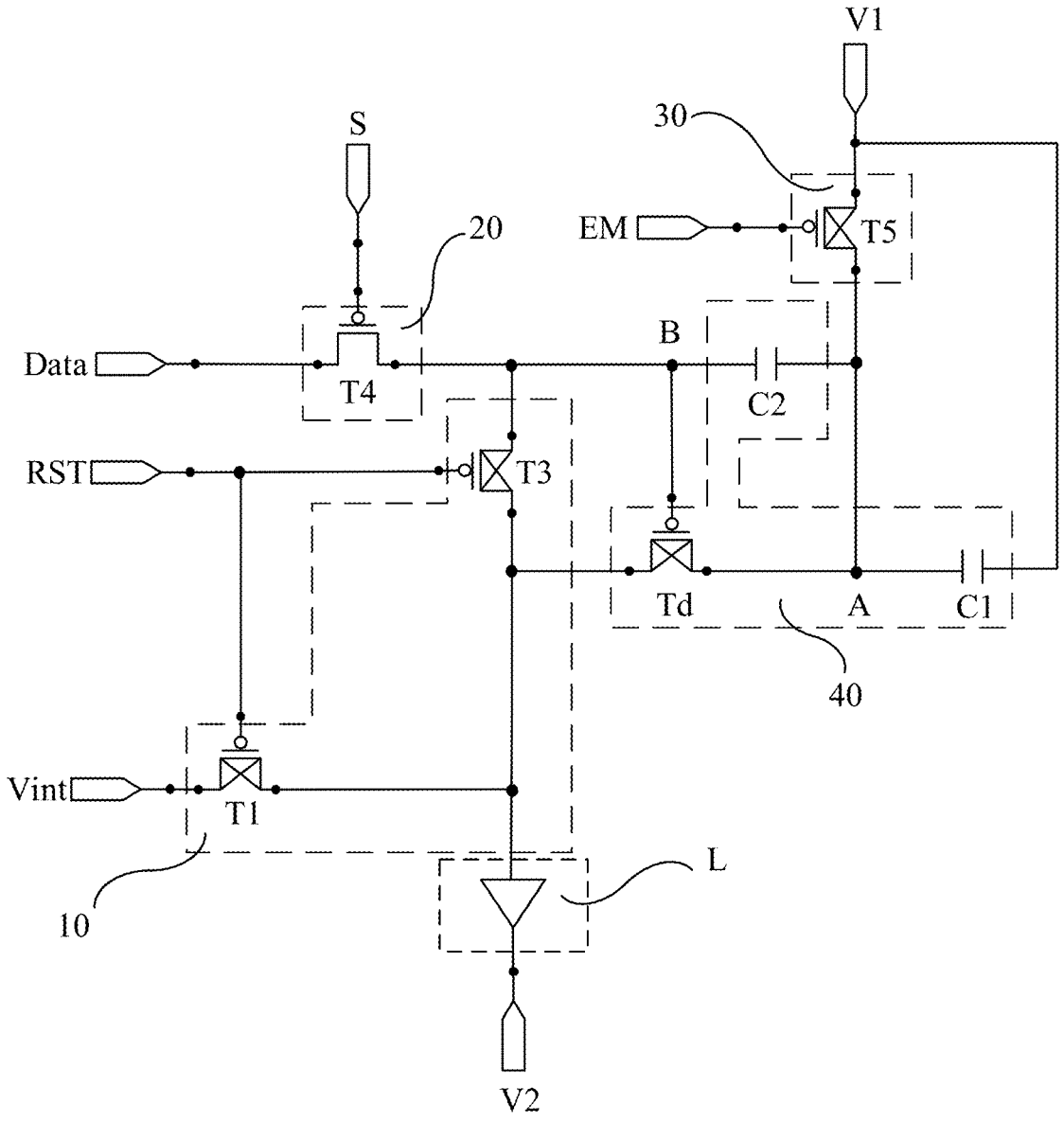
FIG. 5C is an equivalent circuit diagram of the pixel-driving circuits shown in FIG. 3A at a third phase of an image frame.

Based on this, the equivalent circuit diagram of the pixel-driving circuit shown in FIG. 3A is as shown in FIG. 5C. Here transistor T1, T3, and T5 are turned OFF, and transistor T4 is turned ON.

Transistor T4 is turned on so as to cause the data voltage (referred to as $V_{data}$) outputted by the data terminal Data to be written to the gate of the driving transistor Td, and the gate voltage of the driving transistor Td (at point B in FIG. 3A) is changed from $V_0$ of the previous phase to $V_{data}$, where the voltage change amount is $V_{data}-V_0$; transistor T5 is turned OFF, capacitor C2 and C1 form a series structure. Due to the bootstrap action of the second capacitor C2 (point A in FIG. 5C) the amount of voltage change is $$(V_{data}-V_0)\times\frac{C2}{C2+C1}$$

such that the first terminal potential of the driving transistor Td is changed from $V_0+|V_{th}|$ of the previous phase to $$V_0+|V_{th}|+(V_{data}-V_0)\times\frac{C2}{C2+C1},$$

at which time data writing and compensation are completed.

Figure 5D:
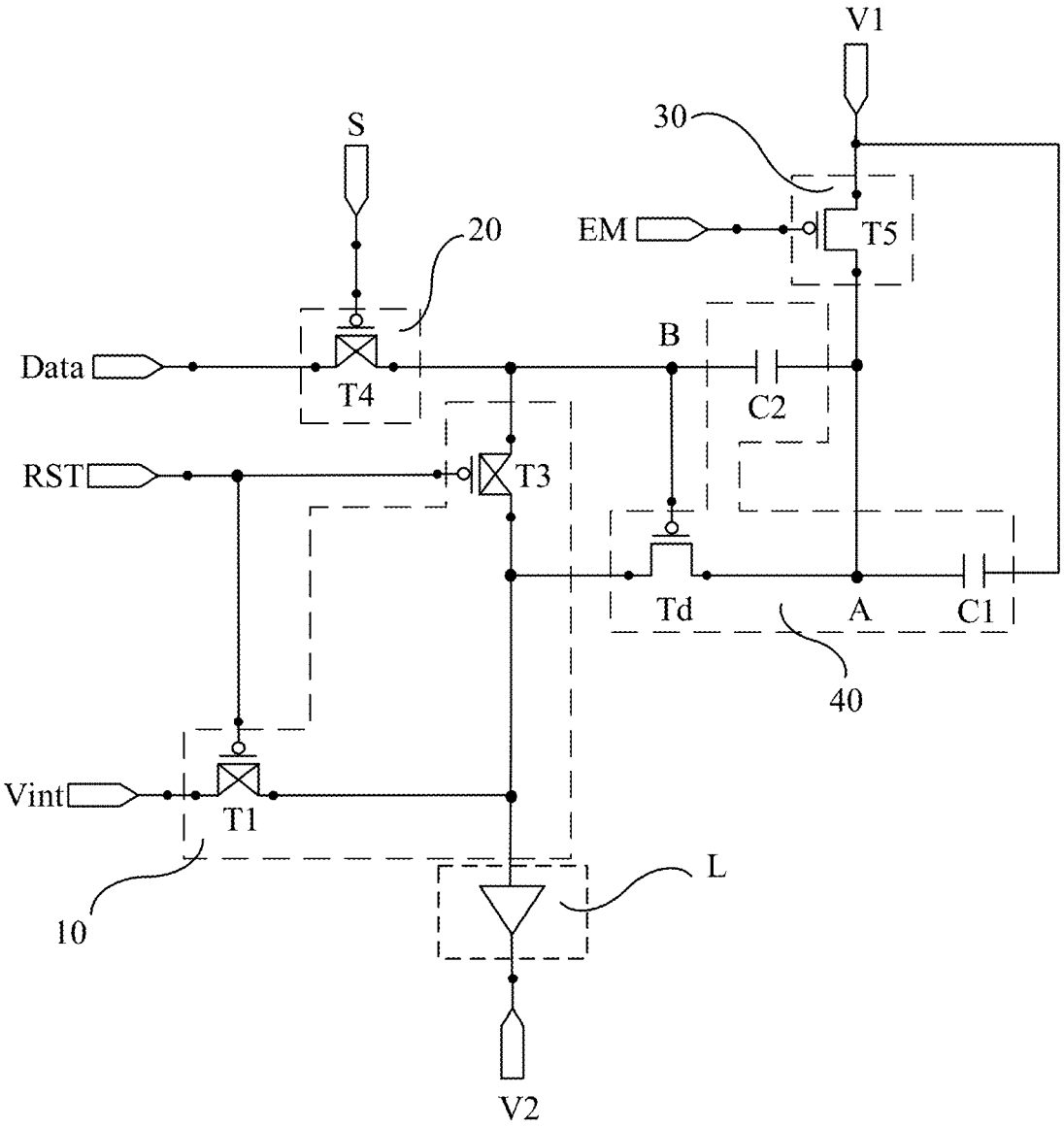
FIG. 5D is an equivalent circuit diagram of the pixel-driving circuits shown in FIG. 3A at a fourth phase of an image frame.

In the light-emitting phase P4, the light-emission control terminal EM outputs a low-level signal, whereas the reset signal terminal RST and the signal scanning terminal S output a high-level signal. Based on this, the equivalent circuit diagram of the pixel circuit shown in FIG. 3A is as shown in FIG. 5D. Here transistor T1, T3, and T4 are turned OFF, and transistor T5 is turned ON.

Transistor T5 is turned on so as to cause the voltage of the first power supply voltage terminal V1 (referred to as $V_{dd}$) to be inputted to the first terminal of the driving transistor Td, and the voltage of the first terminal of the driving transistor Td (at point A in FIG. 5D) is changed from $$V_0+|V_{th}|+(V_{data}-V_0)\times\frac{C2}{C2+C1}$$

of the previous phase to become $V_{dd}$; the amount of voltage change in this case is $$V_{dd}-\left[V_0+|V_{th}|+(V_{data}-V_0)\times\frac{C2}{C2+C1}\right].$$

Due to the bootstrap action of capacitor C2, the gate voltage of the drive transistor Td (at point B in FIG. 5D) is changed to $$V_{data}+V_{dd}-\left[V_0+|V_{th}|+(V_{data}-V_0)\times\frac{C2}{C2+C1}\right]$$

from $V_{data}$ of the previous phase.

Here, since the driving transistor Td has $$V_{gs}=V_{data}+V_{dd}-\left[V_0+|V_{th}|+(V_{data}-V_0)\times\frac{C2}{C2+C1}\right]-V_{dd}=(V_{data}-V_0)\times\frac{C1}{C2+C1}-|V_{th}|<-|V_{th}|,$$

therefore, it is turned ON, and the driving current of the driving transistor Td flows to the light-emitting element L, causing the light emitting device L to emit light. At this time, the current Is that flows through the light emitting device L is:

$$\begin{aligned}Is&=\frac{1}{2}\times K\times|(V_{gs}-(-|V_{th}|))|^2\\&=\frac{1}{2}\times K\times\left|(V_{data}-V_0)\times\frac{C1}{C2+C1}-|V_{th}|-(-|V_{th}|)\right|^2\\&=\frac{1}{2}\times K\times\left((V_{data}-V_0)\times\frac{C1}{C2+C1}\right)^2\end{aligned}$$

wherein K=W/L×C×u, W/L is the aspect ratio of the driving transistor Td, C is the channel insulating layer capacitance, and u is the channel carrier mobility.

It can be seen that the current flowing through the driving transistor Td is only related to the initial voltage inputted by the data terminal Data for realizing the display data voltage $V_{data}$ and the initial voltage terminal $V_{int}$, regardless of the threshold voltage $V_{th}$ of the driving transistor Td, thus eliminating the influence of the threshold voltage $V_{th}$ of the driving transistor Td on the luminance of the light-emitting element L, and the uniformity of the luminance of the light-emitting element L is thereby improved.

Based on the above description of each sub-circuit, the specific driving process of the above pixel-driving circuit will be described in detail below with reference to FIG. 3B, wherein as shown in these embodiments transistors T1, T3, T4, T5, and the driving transistor Td are all P-type transistors, while transistor T2 is an N-type transistor.

In some embodiments, the transistors can be metal-oxide semiconductor transistors (MOS), such as MOS TFT transistors. For example, transistors T1, T3, T4, T5, and the driving transistor Td can be all PMOS TFTs, while transistor T2 is an NMOS TFT.

As shown in FIG. 4, each frame display process of the pixel-driving circuit can be divided into an initial phase P1 and a second phase P2, an input compensation phase P3, and a light-emitting phase P4.

Figure 6A:
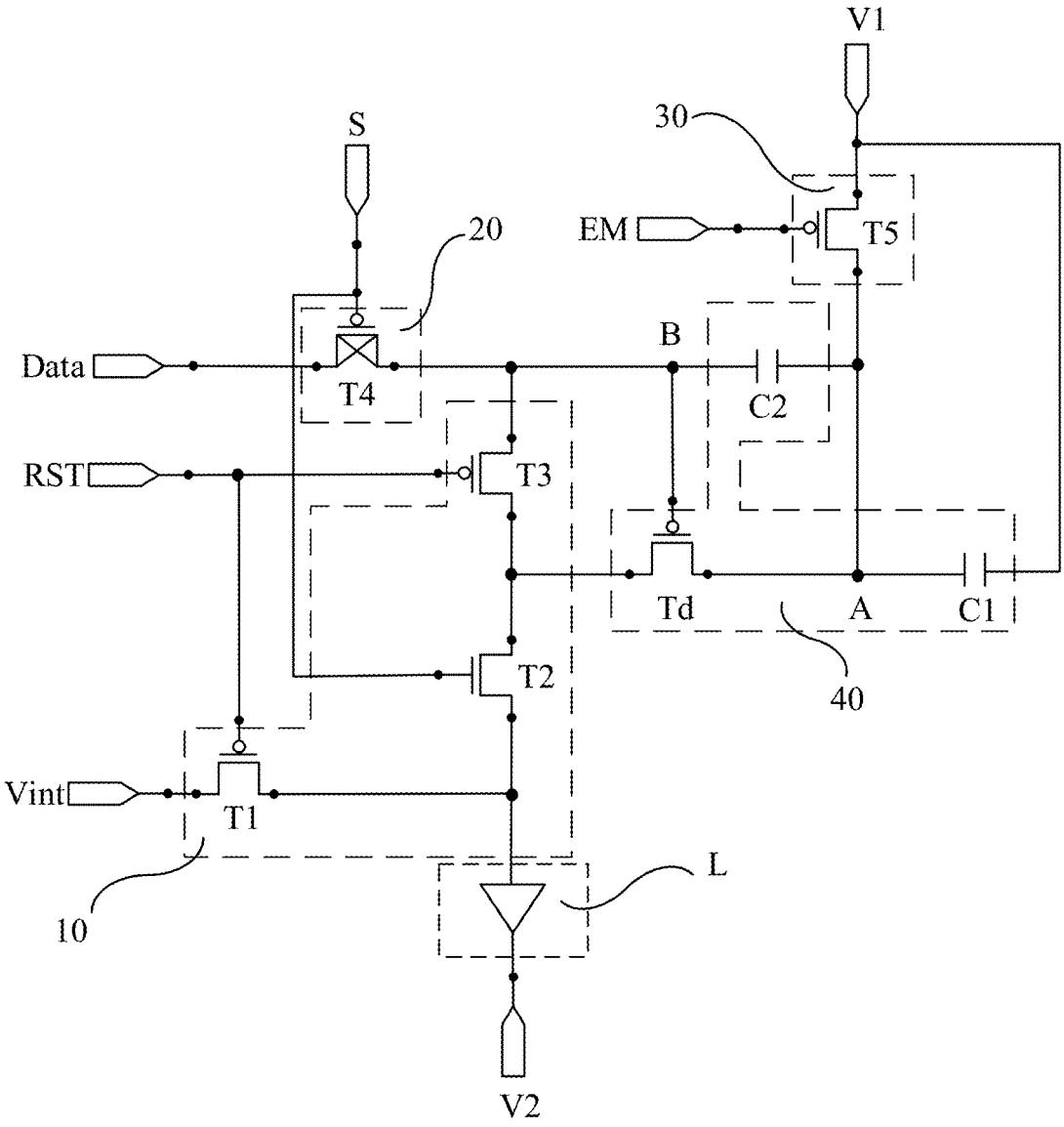
FIG. 6A is an equivalent circuit diagram of the pixel-driving circuit shown in FIG. 3B at each phase of an image frame.

In the initial phase P1 of initialization, the reset signal terminal RST and the light-emission control terminal EM output a low-level signal, and the signal scanning terminal S outputs a high-level signal. Based on this, the equivalent circuit diagram of the pixel-driving circuit shown in FIG. 3B is as shown in FIG. 6A. Transistors T1, T2, T3, and T5 are all turned ON, while transistor T4 is turned OFF.

Transistors T1, T2, and T3 are turned on so as to cause the voltage ($V_0$) of the initial voltage terminal $V_{int}$ to be inputted to the gate of the driving transistor Td; transistor T5 is turned ON so that the first power voltage ($V_{dd}$) output from the terminal V1 is inputted to the first terminal of the driving transistor Td such that $Vgs=V_0-V_{dd}<-|V_{th}|$ for the driving transistor Td, and the driving transistor Td is in an ON state (ON-Bias).

Figure 6B:
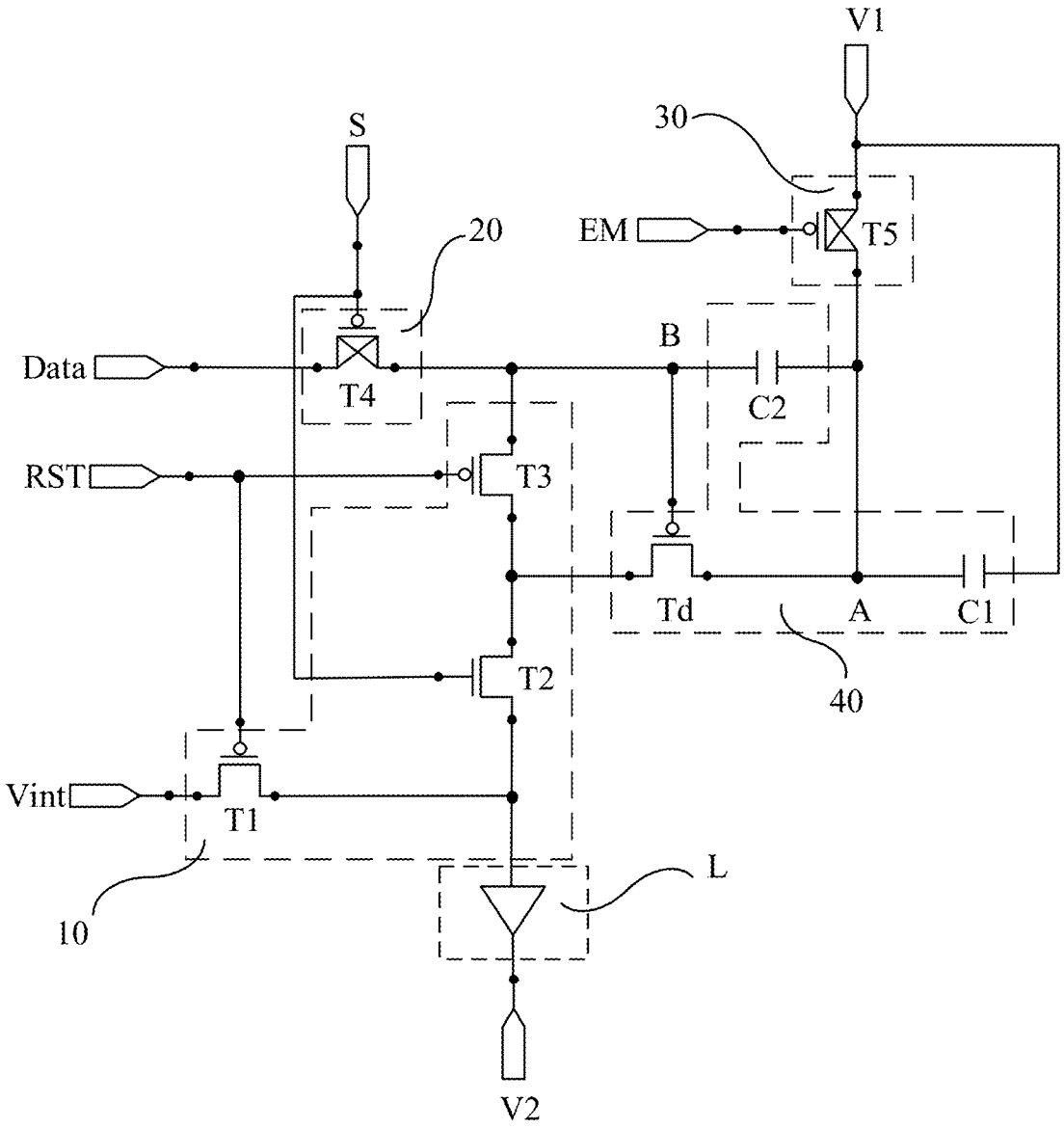
FIG. 6B is an equivalent circuit diagram of the pixel-driving circuit shown in FIG. 3B at each phase of an image frame.

In the second phase of initialization P2, the reset signal terminal RST outputs a low-level signal, and the signal scanning terminal S and the light-emission control terminal EM output a high-level signal. Based on this, the equivalent circuit diagram of the pixel-driving circuit shown in FIG. 3B is as shown in FIG. 6B. Transistors T1, T2, and T3 are all turned ON, while transistors T4 and T5 are both turned OFF.

Transistors T1, T2, and T3 are turned ON so that the voltage ($V_0$) of the initial voltage terminal $V_{int}$ is inputted to the gate of the driving transistor Td; transistor T5 is turned OFF so as to cause the voltage of the first terminal (at point A in FIG. 6B) of the driving transistor Td to start dropping until the driving transistor Td turns off, at which time, the voltage of the first terminal of the driving transistor Td reaches $V_0+|V_{th}|$, and therefore, $V_{gs}=V_0-(V_0+|V_{th}|)=-|V_{th}|$ for the driving transistor Td, so that the driving transistor Td is in an OFF state (OFF-Bias).

After initialization, the driving transistors Td in the pixel-driving circuits of all the sub-pixels of the display panel are all in the same state. Therefore, regardless of the data voltage of the previous frame, the driving transistor Td performs data voltage writing and threshold voltage compensation from the same state, thereby alleviating the short-term afterimage problem caused by the hysteresis effect.

Figure 6C:
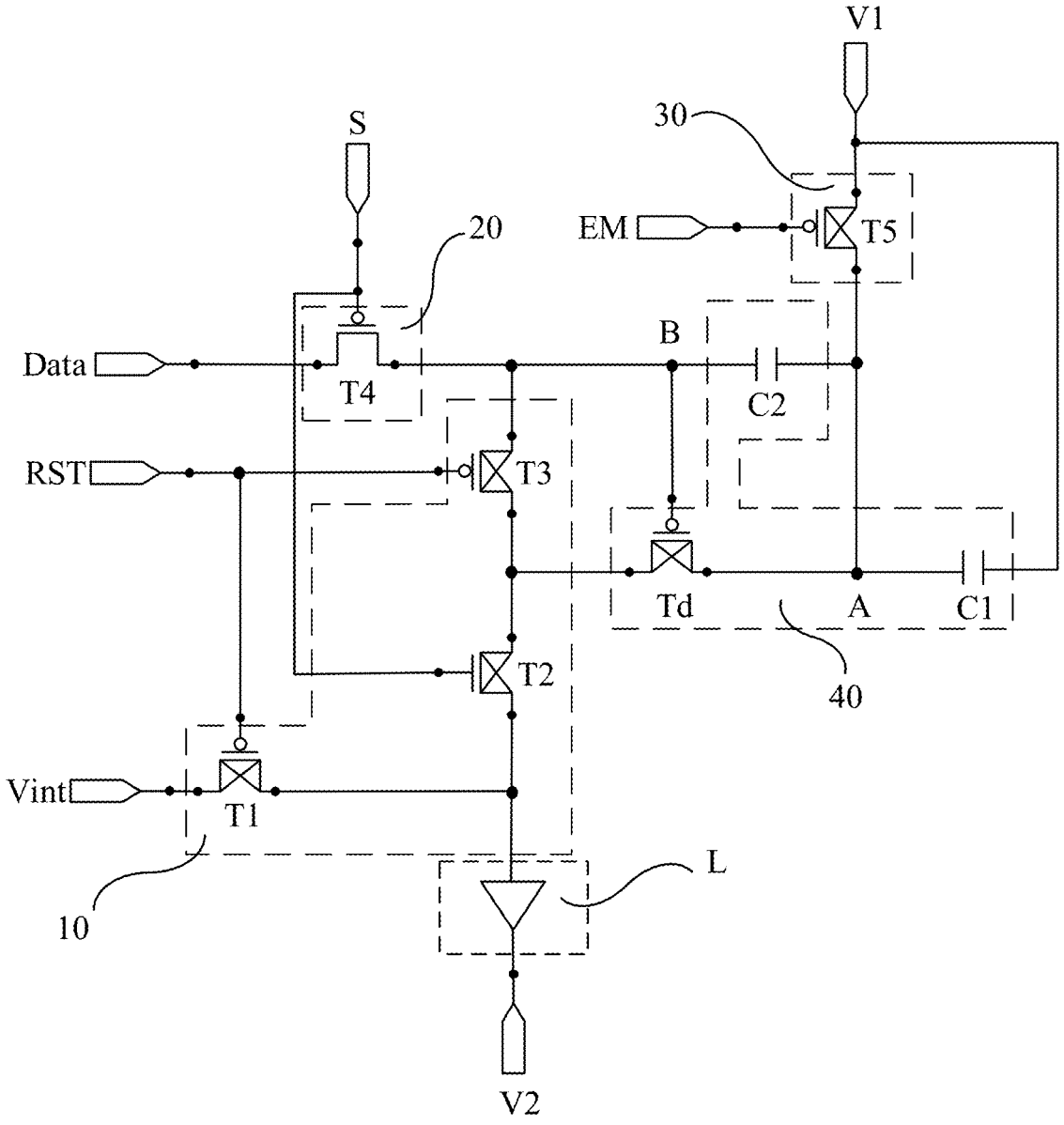
FIG. 6C is an equivalent circuit diagram of the pixel-driving circuit shown in FIG. 3B at each phase of an image frame.

In the write-compensation phase P3, the signal scanning terminal S outputs a low-level signal, the reset signal terminal RST and the light-emission control terminal EM outputs a high-level signal. Based on this, the equivalent circuit diagram of the pixel circuit shown in FIG. 3B is as shown in FIG. 6C. As shown, transistors T1, T2, T3, and T5 are all turned OFF, while transistor T4 is turned ON.

Transistor T4 is turned ON so as to cause the data voltage (referred to as $V_{data}$) outputted by the data terminal Data to be written to the gate of the driving transistor Td, wherein the gate voltage of the driving transistor Td (at point B in FIG. 6C) is changed from $V_0$ of the previous phase to $V_{data}$. The voltage change amount in this case is $V_{data}-V_0$; transistor T5 is turned OFF, capacitor C2 and C1 form a series structure. Due to the bootstrap action of capacitor C2 (point A in FIG. 6C) the amount of voltage change is $$(V_{data}-V_0)\times\frac{C2}{C2+C1}$$

such that the first terminal potential of the driving transistor Td is changed from $V_0+|V_{th}|$ of the previous phase, at which time data writing and compensation are completed.

Figure 6D:
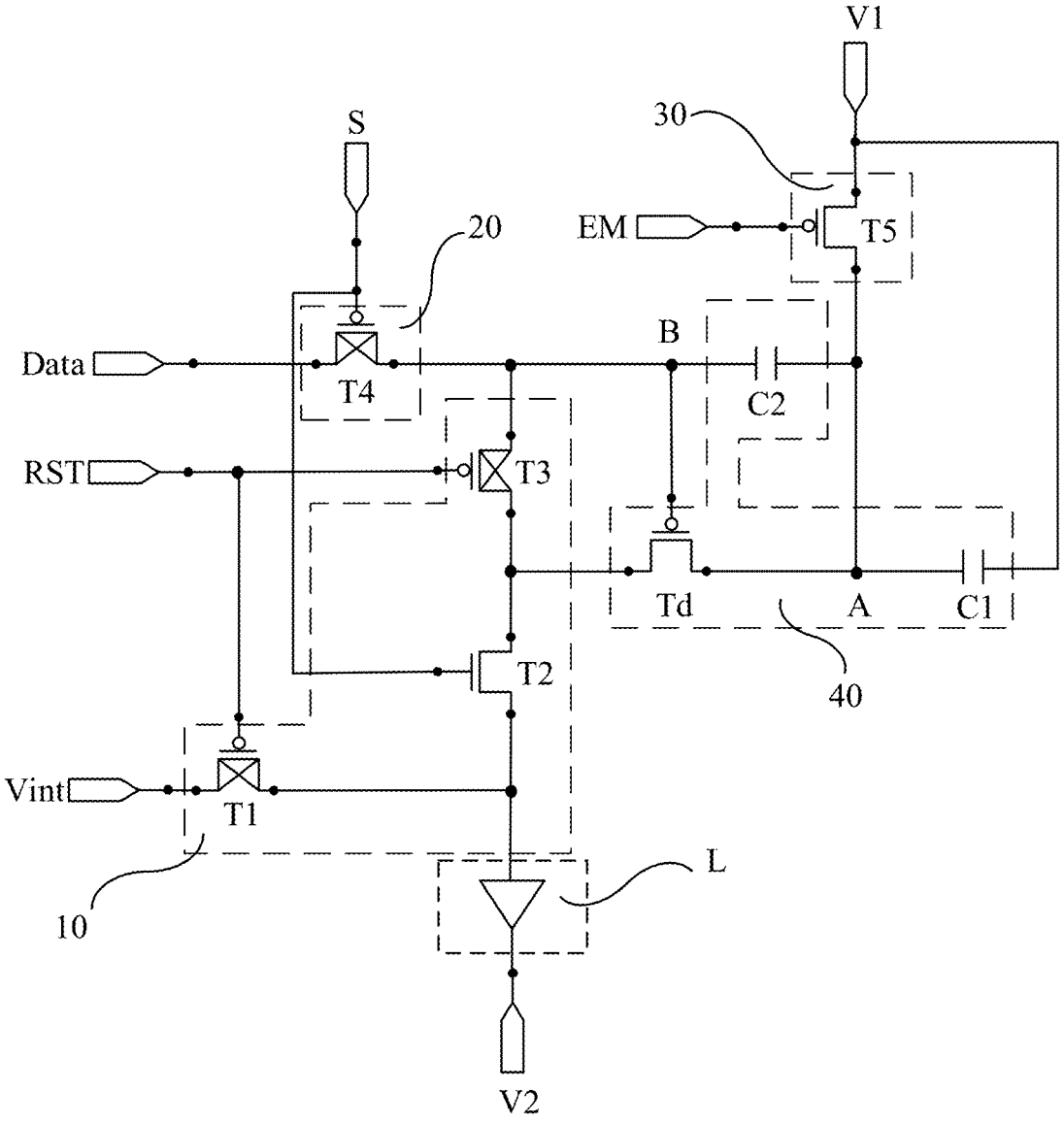
FIG. 6D is an equivalent circuit diagram of the pixel-driving circuit shown in FIG. 3B at each phase of an image frame.

In the light-emitting phase P4, the light-emission control terminal EM outputs a low-level signal, and the reset signal terminal RST and the signal scanning terminal S output a high-level signal. Based on this, the equivalent circuit diagram of the pixel circuit shown in FIG. 3B is as shown in FIG. 6D. Transistors T1, T3, and T4 are all turned OFF, while transistors T2 and T5 are turned ON.

Transistor T5 is turned ON so as to cause the voltage ($V_{dd}$) of the first power voltage terminal V1 to be inputted to the first terminal of the driving transistor Td, in which the voltage of the first terminal of the driving transistor Td is changed from $$V_0+|V_{th}|+(V_{data}-V_0)\times\frac{C2}{C2+C1}$$

of the previous phase to $V_{dd}$, and the voltage is changed to $$V_{dd}-\left[V_0+|V_{th}|+(V_{data}-V_0)\times\frac{C2}{C2+C1}\right].$$

Due to the bootstrap action of capacitor C2, the gate voltage of the driving transistor Td (at point B in FIG. 6D) is changed from $V_{data}$ of the previous phase to $$V_{dd}-\left[V_0+|V_{th}|+(V_{data}-V_0)\times\frac{C2}{C2+C1}\right]+V_{data}.$$

Here, since the driving transistor Td has $$V_{gs}=V_{data}+V_{dd}-\left[V_0+|V_{th}|+(V_{data}-V_0)\times\frac{C2}{C2+C1}\right]-V_{dd}=(V_{data}-V_0)\times\frac{C1}{C2+C1}-|V_{th}|<-|V_{th}|,$$

thus, Td is turned ON and the driving current of the driving transistor Td flows to the light-emitting element L, causing the light-emitting element L to emit light. At this time, the current Is that flows through the light emitting device L is:

$$\begin{aligned}Is&=\frac{1}{2}\times K\times|(V_{gs}-(-|V_{th}|))|^2\\&=\frac{1}{2}\times K\times\left|(V_{data}-V_0)\times\frac{C1}{C2+C1}-|V_{th}|-(-|V_{th}|)\right|^2\\&=\frac{1}{2}\times K\times\left((V_{data}-V_0)\times\frac{C1}{C2+C1}\right)^2\end{aligned}$$

wherein K=W/L×C×u, W/L is the aspect ratio of the driving transistor Td, C is the channel insulating layer capacitance, and u is the channel carrier mobility.

It can be seen that the current flowing through the driving transistor Td is only related to the initial voltage input by the data terminal Data for realizing the display data voltage $V_{data}$ and the initial voltage terminal $V_{int}$, regardless of the threshold voltage $V_{th}$ of the driving transistor Td, thus eliminating the influence of the threshold voltage $V_{th}$ of the driving transistor Td has on the luminance of the light-emitting element L, and the uniformity of the luminance of the light-emitting element L is thereby alleviated.

In some embodiments, the present disclosure further provides a display panel comprising a plurality of sub-pixels, each of the sub-pixels comprising the pixel driving circuit described above.

In some embodiments, the present disclosure further provides a driving method of the above pixel driving circuit. Implementations of the method and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more modules of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A non-transitory computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium may be tangible.

Processors or processing circuits suitable for the execution of a computer program include, by way of example, both general and special purpose microprocessors, such as application specific integrated circuits (ASICs), digital signal processors (DSPs), digital signal processing apparatuses (DSPDs), programmable logic apparatuses (PLDs), field programmable gate arrays (FPGAs), controllers, micro-controllers, microprocessors or other electronic components and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Figure 7:
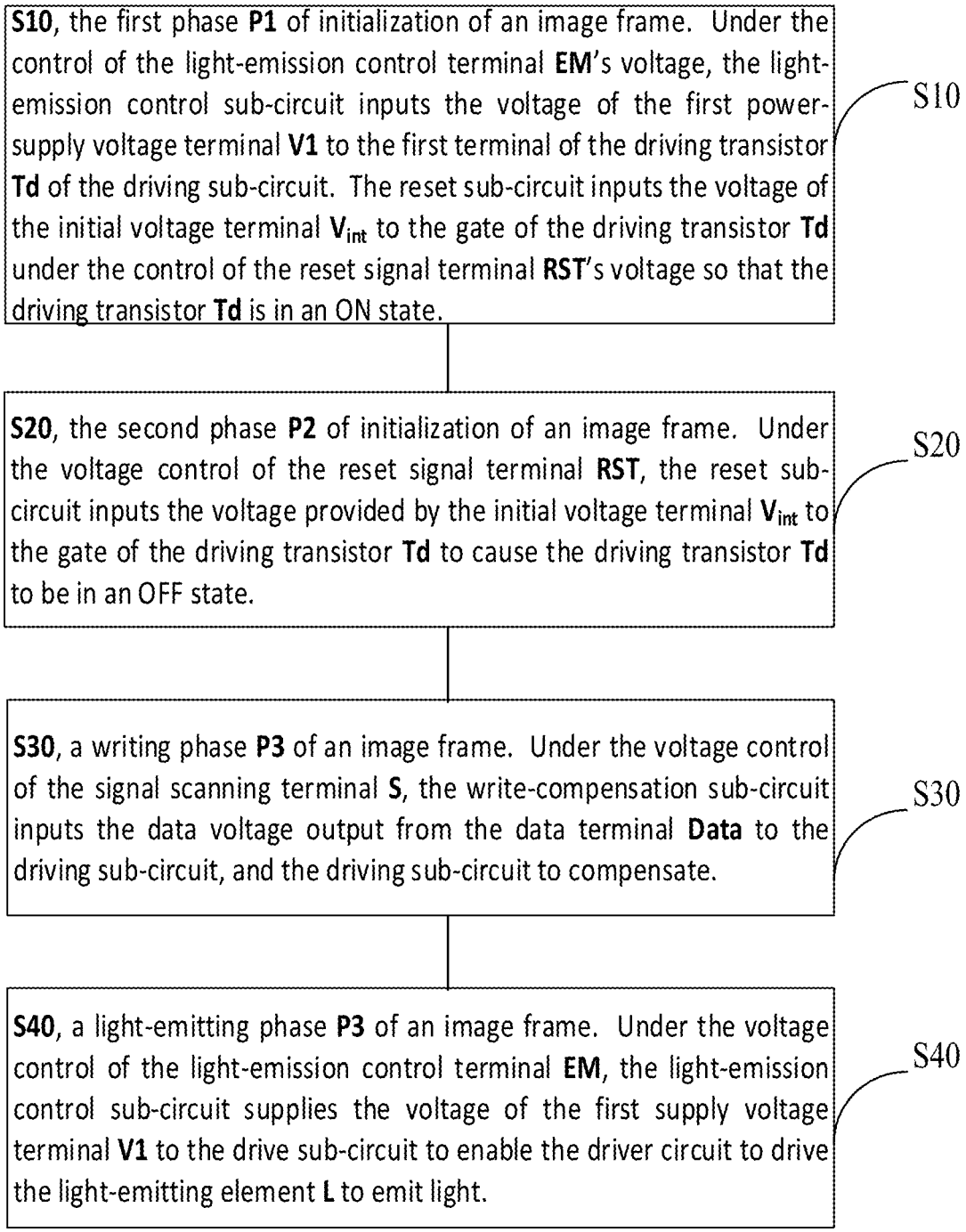
FIG. 7 shows a schematic diagram of a driving method of a pixel-driving circuit in accordance with embodiments of the present disclosure.

As shown in FIG. 7, the driving method includes:

S10. the first phase P1 of initialization of an image frame. Under the control of the light-emission control terminal EM's voltage, the light-emission control sub-circuit 30 inputs the voltage of the first power-supply voltage terminal V1 to the first terminal of the driving transistor Td of the driving sub-circuit 40. The reset sub-circuit 10 inputs the voltage of the initial voltage terminal $V_{int}$ to the gate of the driving transistor Td under the control of the reset signal terminal RST's voltage so that the driving transistor Td is in an ON state.

Taking the pixel-driving circuit shown in FIG. 3B as an example, when the reset signal terminal RST outputs a low-level signal, the signal scanning terminal S outputs a high-level signal, and the equivalent circuit diagram of the pixel circuit shown in FIG. 3B is as shown in FIG. 6A. Transistors T1, T2, T3, and T5 are all turned ON, while transistor T4 is turned OFF.

Transistor T1, T2, and T3 are turned ON, and the voltage ($V_0$) of the initial voltage terminal $V_{int}$ is input to the gate of the driving transistor Td to reset the gate of the driving transistor Td.

Transistor T5 is turned ON so as to cause the voltage ($V_{dd}$) outputted from the first power supply voltage terminal V1 to be inputted to the first terminal of the driving transistor Td, wherein the driving transistor Td has $V_{gs}=V_0-V_{dd}<-|V_{th}|$, and the driving transistor Td is in the ON state (ON-Bias).

S20, the second phase P2 of initialization of an image frame. Under the voltage control of the reset signal terminal RST, the reset sub-circuit 10 inputs the voltage provided by the initial voltage terminal $V_{int}$ to the gate of the driving transistor Td to cause the driving transistor Td to be in an OFF state.

Taking the pixel-driving circuit shown in FIG. 3B as an example, when the reset signal terminal RST outputs a low-level signal, the signal scanning terminal S and the light-emission control terminal EM output a high-level signal. Based on this, the equivalent pixel-driving circuit shown in FIG. 3B, etc is as shown in FIG. 6B. Transistor T1, T2, and T3 are both turned ON, while transistor T4 and T5 are both turned OFF.

When transistors T1, T2, and T3 are turned ON, the voltage ($V_0$) of the initial voltage terminal $V_{int}$ is inputted to the gate of the driving transistor Td. Transistor T5 is turned OFF which causes the voltage of the first terminal (at point A in FIG. 6B) of the driving transistor Td to start dropping until the driving transistor Td turns off, at which time, the voltage of the first terminal of the driving transistor Td reaches $V_0+|V_{th}|$, and therefore, $V_{gs}=V_0-(V_0+|V_{th}|)=-|V_{th}|$ for the driving transistor Td, so that the driving transistor Td is in an off state (OFF-Bias). The voltage supplied from the initial voltage terminal $V_{int}$ is inputted to the anode of the light emitting device L, thereby resetting the residual charge on the anode of the light emitting device L, protecting the light emitting device L S30, a writing phase P3 of an image frame. Under the voltage control of the signal scanning terminal S, the write-compensation sub-circuit 20 inputs the data voltage output from the data terminal Data to the driving sub-circuit 40, and the driving sub-circuit 40 to compensate.

Taking the pixel-driving circuit shown in FIG. 3B as an example, when the signal scanning terminal S outputs a low-level signal, the reset signal terminal RST and the light-emission control terminal EM outputs a high-level signal. Based on this, the equivalent pixel-driving circuit shown in FIG. 3B is as shown in FIG. 6C. Transistors T1, T2, T3, and T5 are all turned OFF, and T4 is turned ON.

When transistor T4 is turned ON, the data voltage ($V_{data}$) outputted from the data terminal Data is written to the gate of the driving transistor Td, and the gate voltage of the driving transistor Td (at point B in FIG. 6C) changes from $V_0$ of the previous phase to $V_{data}$, wherein the voltage change amount is $V_{data}-V_0$; transistor T5 is turned OFF, capacitor C2 and C1 form a series structure. Due to the bootstrapping action of capacitor C2 (point A in FIG. 6C) where the voltage variation of the point is $$(V_{data}-V_0)\times\frac{C2}{C2+C1}$$

such that the first terminal potential of the driving transistor Td is changed from $V_0+|V_{th}|$ of the previous phase to $$V_0+|V_{th}|+(V_{data}-V_0)\times\frac{C2}{C2+C1},$$

at which time data writing and compensation are completed.

S40, a light-emitting phase P3 of an image frame. Under the voltage control of the light-emission control terminal EM, the light-emission control sub-circuit 30 supplies the voltage of the first supply voltage terminal V1 to the drive sub-circuit 40 to enable the driver circuit 40 to drive the light-emitting element L to emit light.

Taking the pixel-driving circuit shown in FIG. 3B as an example, when the light-emission control terminal EM outputs a low-level signal, the reset signal terminal RST and the signal scanning terminal S output a high-level signal.

Based on this, the equivalent circuit of that shown in FIG. 3B is as shown in FIG. 6D. Transistor T1, T3, and T4 are all turned OFF, while T2 and T5 are turned ON.

When transistor T5 is turned ON, the voltage ($V_{dd}$) supplied from the first power voltage terminal V1 is inputted to the first terminal of the driving transistor Td, and the voltage of the first terminal of the driving transistor Td (at point A in FIG. 6D) is changed from $$V_0 + |V_{th}| + (V_{data} - V_0) \times \frac{C2}{C2 + C1}$$

of the previous phase to $V_{dd}$, wherein the amount of voltage change is $$V_{dd} - \left[V_0 + |V_{th}| + (V_{data} - V_0) \times \frac{C2}{C2 + C1}\right].$$

Due to the bootstrap action of capacitor C2, the gate voltage of the driving transistor Td (at point B in FIG. 6D) is changed from the $V_{data}$ of the previous phase $$V_{data} + V_{dd} - \left[V_0 + |V_{th}| + (V_{data} - V_0) \times \frac{C2}{C2 + C1}\right].$$

Here, since the driving transistor Td has a $$V_{gs} = V_{data} + V_{dd} - \left[V_0 + |V_{th}| + (V_{data} - V_0) \times \frac{C2}{C2 + C1}\right] - V_{dd} = (V_{data} - V_0) \times \frac{C1}{C2 + C1} - |V_{th}| < -|V_{th}|,$$

therefore, the driving transistor Td is turned ON, and the driving current of the driving transistor Td flows to the light-emitting element L, causing the light emitting device L to emit light. At this time, the current Is flowing through the light emitting device L is:

$$\begin{aligned} Is &= \frac{1}{2} \times K \times |(V_{gs} - (-|V_{th}|))|^2 \\ &= \frac{1}{2} \times K \times \left|(V_{data} - V_0) \times \frac{C1}{C2 + C1} - |V_{th}| - (-|V_{th}|)\right|^2 \\ &= \frac{1}{2} \times K \times \left((V_{data} - V_0) \times \frac{C1}{C2 + C1}\right)^2 \end{aligned}$$

wherein K=W/L×C×u, W/L is the aspect ratio of the driving transistor Td, C is the channel insulating layer capacitance, and u is the channel carrier mobility.

It can be seen that the current flowing through the driving transistor Td is only related to the initial voltage input by the data terminal Data for realizing the display data voltage $V_{data}$ and the initial voltage terminal $V_{int}$, and is independent of the threshold voltage $V_{th}$ of the driving transistor Td.

As such. the influence of the threshold voltage $V_{th}$ of the driving transistor Td has on the luminance of the light-emitting element L is eliminated, and the uniformity of the luminance of the light-emitting element L is thereby alleviated.

Based on the above, in the above S10, the first phase P1 of the image frame initialization process, operating under the voltage control of the reset signal terminal RST, the reset sub-circuit 10 inputs the voltage supplied from the initial voltage terminal $V_{int}$ to the gate of transistor Td so as to cause Td to be in an ON state, the process includes: a first phase P1 of initialization of an image frame, under the voltage control of the reset signal terminal RST and the voltage of the scanning signal terminal S, the reset sub-circuit 10 inputs the voltage supplied from the initial voltage terminal $V_{int}$ to the gate of the driving transistor Td so that the driving transistor Td is in an ON state.

Taking the circuit shown in FIG. 3B as an example, a full understanding of this process can be obtained by referring to the above description of P1 in conjunction with the drawings, and will not be described herein again.

In the above S20, the second phase P2 of the initialization of an image frame, operating under the voltage control of the reset signal terminal RST, the reset sub-circuit 10 inputs the voltage supplied from the initial voltage terminal $V_{int}$ to the gate of the transistor Td so as to cause transistor Td to be in an OFF state, the process includes: a second phase P2 of initialization of an image frame, under the voltage control of the reset signal terminal RST and the signal scanning terminal S, the reset sub-circuit 10 inputs the voltage supplied from the initial voltage terminal $V_{int}$ to the gate of the driving transistor Td, so that the driving transistor Td is in an OFF state.

Taking the circuit shown in FIG. 3B as an example, a full understanding of this process may be obtained by referring to the above description of P2 in conjunction with the drawings and shall not be described herein again.

Based on the above, in the case where the reset sub-circuit 10 is also operatively connected to the light-emitting element L, the driving method of the pixel-driving circuit further includes: in the first phase and the second phase of initialization of an image frame, under the control of the voltage from the reset signal terminal RST and the voltage of the signal scanning terminal S, the reset sub-circuit 10 inputs the voltage supplied from the initial voltage terminal $V_{int}$ to the light-emitting element L so as to cause the light emitting device L to be reset.

The voltage supplied from the initial voltage terminal $V_{int}$ is inputted to the anode of the light-emitting element L, thereby resetting the charge remaining on the anode of the light-emitting element L to protect the light-emitting element L.

Various embodiments of the present disclosure also provide a display apparatus employing a display panel and the driving circuits and driving method as described above.

The display panel can be an OLED display or other types of displays.

The display apparatus can further include, for example, a speaker, a power supply, and a controller to control the speaker and the display panel. The display apparatus can be configured as a smart TV, for example, of which various modular components of speakers, microphones, antenna, receivers, set-top boxes, etc., to realize a reconfigurable/expandable/plug-and-play apparatus.

In some other examples, the display apparatus can be configured as a computer, a smart phone, a tablet computer, etc.

At least some embodiments of the present disclosure can have one or more of the following advantages. For example, according to some embodiments, the driving circuits employ a transistor T2 using an NMOS TFT, and the remaining TFTs are all PMOS. In the first phase, the gate and source of the driving TFT (Td; also referred to as DTFT) are provided Vint and respectively, such that Td is in the On-Bias state.

In the second phase, the gate and source of the Td are provided Vint and Vint−Vth, respectively, such that the DTFT is off. The-Bias state, after the first and second phases, fully guarantees the consistency of the initial interface state of the TFT.

Therefore, regardless of whether the data voltage of the previous frame corresponds to black or white, Td starts to write and compensate data in the same state. The short-term residual image problem caused by the hysteresis effect is improved. Meanwhile, the compensation circuit also reduces or eliminates the influence of the V1 IR Drop and the driving TFT threshold voltage drift on the OLED light-emitting current.

As such, in the pixel-driving circuit, driving method, and display panel provided by various embodiments of the present disclosure, data voltages from the data terminal can be provided to the driving sub-circuit during the image frame writing phase by the write-compensation sub-circuit, such that the driving sub-circuit is compensated.

When the driving sub-circuit is driven to emit light, the current flowing through the light-emitting element is independent of the threshold voltage of the driving transistor, thereby reducing or eliminating the influence of the threshold voltage on the brightness of the light, and improving display uniformity.

Further, by causing the driving transistor to be in an ON state (ON-Bias) in the first phase of image frame initialization, and in an OFF state (OFF-Bias) in the second phase of image frame initialization, the effect of temporary afterimage is greatly reduced or eliminated.

Therefore, regardless of the data voltage of the previous frame, in some embodiments of the present disclosure, the driving transistor is subjected to data voltage writing and threshold voltage compensation from the same state, thereby reducing or eliminating the temporary afterimage problem caused by the hysteresis effect, as well as the threshold voltage drift problem that impacts brightness uniformity of the display.

It is apparent that those of ordinary skill in the art can make various modifications and variations to the embodiments of the disclosure without departing from the spirit and scope of the disclosure. Thus, it is intended that the present disclosure cover the modifications and the modifications.

Various embodiments in this specification have been described in a progressive manner, where descriptions of some embodiments focus on the differences from other embodiments, and same or similar parts among the different embodiments are sometimes described together in only one embodiment.

It should also be noted that in the present disclosure, relational terms such as first and second, etc., are only used to distinguish one entity or operation from another entity or operation, and do not necessarily require or imply these entities having such an order or sequence. It does not necessarily require or imply that any such actual relationship or order exists between these entities or operations.

Moreover, the terms "include," "including," or any other variations thereof are intended to cover a non-exclusive inclusion within a process, method, article, or apparatus that comprises a list of elements including not only those elements but also those that are not explicitly listed, or other elements that are inherent to such processes, methods, goods, or equipment.

In the case of no more limitation, the element defined by the sentence "includes a . . . " does not exclude the existence of another identical element in the process, the method, or the device including the element.

Specific examples are used herein to describe the principles and implementations of some embodiments. The description is only used to help convey understanding of the possible methods and concepts. Meanwhile, those of ordinary skill in the art may change the specific manners of implementation and application thereof without departing from the spirit of the disclosure. The contents of this specification therefore should not be construed as limiting the disclosure.

For example, in the description of the present disclosure, the terms "some embodiments," or "example," and the like may indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described may be combined in a suitable manner in any one or more embodiments or examples. In addition, various embodiments or examples described in the specification, as well as features of various embodiments or examples, may be combined and reorganized.

In the descriptions, with respect to circuit(s), unit(s), device(s), component(s), etc., in some occurrences singular forms are used, and in some other occurrences plural forms are used in the descriptions of various embodiments. It should be noted; however, the single or plural forms are not limiting but rather are for illustrative purposes. Unless it is expressly stated that a single unit, device, or component etc. is employed, or it is expressly stated that a plurality of units, devices or components, etc. are employed, the circuit(s), unit(s), device(s), component(s), etc. can be singular, or plural.

Based on various embodiments of the present disclosure, the disclosed apparatuses, devices, and methods may be implemented in other manners. For example, the abovementioned devices can employ various methods of use or implementation as disclosed herein.

Dividing the device into different "regions," "units," or "layers," etc. merely reflect various logical functions according to some embodiments, and actual implementations can have other divisions of "regions," "units," or "layers," etc. realizing similar functions as described above, or without divisions. For example, multiple regions, units, or layers, etc. may be combined or can be integrated into another system. In addition, some features can be omitted, and some steps in the methods can be skipped.

Those of ordinary skill in the art will appreciate that the units, regions, or layers, etc. in the devices provided by various embodiments described above can be provided in the one or more devices described above. They can also be located in one or multiple devices that is (are) different from the example embodiments described above or illustrated in the accompanying drawings. For example, the units, regions, or layers, etc. in various embodiments described above can be integrated into one module or divided into several sub-modules.

The order of the various embodiments described above are only for the purpose of illustration, and do not represent preference of embodiments.

Although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to the disclosed aspects of the exemplary embodiments can be made in addition to those described above by a person of ordinary skill in the art having the benefit of the present disclosure without departing from the spirit and scope of the disclosure contemplated by this disclosure and as defined in the following claims. As such, the scope of this disclosure is to be accorded the broadest reasonable interpretation so as to encompass such modifications and equivalent structures.

The invention claimed is:

1. A pixel-driving circuit, comprising:

a reset sub-circuit;

a write-compensation sub-circuit;

a light-emission control sub-circuit; and a driving sub-circuit having a driving transistor, wherein:

the write-compensation sub-circuit is operatively connected to a signal scanning terminal, a data terminal, and the driving sub-circuit; and is configured to provide voltages of the data terminal to the driving sub-circuit, controlled with voltage from the signal scanning terminal, so as to compensate the driving sub-circuit, during a write-compensation phase of an image frame;

the light-emission control sub-circuit is operatively connected to a light-emission control terminal, a first power source terminal, and the driving sub-circuit; and is configured to provide voltages of the first power source terminal to a first terminal of the driving transistor, controlled with voltage from the light-emission control terminal, during a first initialization phase and a light-emitting phase of the image frame;

the driving sub-circuit is further operatively connected to the first power source terminal;

the reset sub-circuit is operatively connected to a reset terminal, the initial voltage terminal, and the driving sub-circuit, wherein the reset sub-circuit is configured to provide voltages of the initial voltage terminal to a gate of the driving transistor, controlled with voltage from the reset terminal, during the first and the second initialization phases of the image frame, so as to cause the driving transistor to be in an ON state during the first initialization phase and in an OFF state during the second initialization phase.

2. The pixel-driving circuit of claim 1, wherein:

the reset sub-circuit is further operatively connected to the signal scanning terminal; and the reset sub-circuit is configured to provide voltages of the initial voltage terminal to the gate of the driving transistor, controlled with voltages from the power source terminal and the signal scanning terminal, during the first and second phase of initialization so as to cause the driving transistor to be in an ON state during the first phase of initialization and in an OFF state during the second phase of initialization.

3. The pixel-driving circuit of claim 2, further comprising a light-emitting element, and wherein:

the light-emitting element is driven by the driving sub-circuit to emit light;

the light-emitting element is operatively connected to the second power source terminal;

the reset sub-circuit is further operatively connected to the light-emitting element, and is configured to provide voltages of the initial voltage terminal to the light-emitting element during the first and the second initialization phases of the image frame so as to cause reset of the light-emitting element and cause the driving sub-circuit to operatively connect with the light-emitting element during the light-emitting phase under voltage control of the signal scanning terminal.

4. The pixel-driving circuit of claim 2, wherein the reset sub-circuit includes transistors T1, T2, and T3, and wherein;

a gate of T1 is operatively connected to the reset terminal, a first terminal of T1 is operatively connected to the initial voltage terminal, a second terminal of T1 is operatively connected to a first terminal of T2;

a gate of T2 is operatively connected to the reset terminal, a second terminal of T2 is operatively connected to a second terminal of the driving transistor; and a gate of T3 is operatively connected to the reset terminal, a first terminal of T3 is operatively connected to the second terminal of T2, a second terminal of T3 is operatively connected to the gate of the driving transistor.

5. The pixel-driving circuit of claim 4, wherein the write-compensation sub-circuit includes a transistor T4, and wherein:

a gate of T4 is operatively connected to the reset terminal;

a first terminal of T4 is operatively connected to the data terminal; and a second terminal of T4 is operatively connected to the gate of the driving transistor.

6. The pixel-driving circuit of claim 5, wherein the light-emission control sub-circuit include a transistor T5, and wherein:

a gate of T5 is operatively connected to the light-emission control terminal;

a first terminal of T5 is operatively connected to the first power source terminal; and a second terminal of T5 is operatively connected to the driving sub-circuit.

7. The pixel-driving circuit according claim 6, wherein the driving sub-circuit further includes capacitors C1 and C2, and wherein:

a first terminal of C1 is operatively connected to the first power source terminal;

a second terminal of C1 is operatively connected to the first terminal of the driving transistor;

a first terminal of C2 is operatively connected to the gate of the driving transistor; and a second terminal of C2 is operatively connected to the first terminal of the driving transistor and the light-emission control sub-circuit.

8. The pixel-driving circuit according to claim 6, wherein T2 is an N-type metal oxide semiconductor (NMOS) thin-film transistor (TFT); and T1, the driving transistor, T3, T4, and T5 are P-type metal oxide semiconductor (PMOS) TFTs.

9. The pixel-driving circuit according to claim 8, wherein a voltage from the initial voltage terminal is applied to the gate of the driving transistor during the first initialization phase, and a threshold-compensated voltage from the initial voltage terminal is applied to the gate of the driving transistor during the second initialization phase, to thereby reduce IR drop from the first power source terminal and threshold voltage shifting of the driving transistor.

10. The pixel-driving circuit of claim 1, wherein the reset sub-circuit comprises transistors T1 and T3, and wherein:

a gate of T1 is operatively connected to the reset terminal, the first terminal of T1 is operatively connected to the initial voltage terminal, the second terminal of T1 is operatively connected to a first terminal of T3 and a second terminal of the driving transistor;

a gate of T3 is operatively connected to the reset terminal, a second terminal of T3 is operatively connected to the gate of the driving transistor.

11. A display panel comprising a plurality of pixel elements, wherein each pixel element includes a pixel-driving circuit according to claim 1.

12. The display panel of claim 11, wherein the pixel-driving circuit comprises a light-emitting element, and the light-emitting element is an organic light-emitting diode (OLED).

13. A display apparatus comprising the display panel of claim 12, and a processing circuit configured to:

during the first initialization phase of the image frame, place the driving transistor to be in an ON state by:

providing, with the light-emission control sub-circuit, voltage of the first power source terminal, to the first terminal of the driving transistor, controlled with voltage from the light-emission terminal;

providing, with the reset sub-circuit, voltage of the initial voltage terminal to the gate of the driving transistor, controlled with voltage from the reset signal terminal;

during the second initialization phase of the image frame, placing the driving transistor in an OFF state by:

providing, with the reset sub-circuit, voltage of the initial voltage terminal to the gate of the driving transistor, controlled with voltage from the reset terminal, during the writing phase of the image frame, compensate the driving sub-circuit by:

providing, with the write-compensation sub-circuit, voltage of the data terminal to the driving sub-circuit, controlled with voltage from the signal scanning terminal, during the light-emitting phase of the image frame, drive the light-emitting element to emit light by:

providing, with the light-emission control sub-circuit, voltage of the first power source terminal to the driving sub-circuit, controlled with voltage from the light-emission control terminal so as to cause the driving sub-circuit to drive the light-emitting element to emit light.

14. The display apparatus of claim 13, further comprising a non-transitory computer-readable storage medium having instructions stored thereon for execution by the processor to control the pixel-driving circuit.

15. The display apparatus of claim 14, wherein the display apparatus is one of a smart TV, a computer, a smart phone, or a tablet computer.

16. The display apparatus of claim 14, wherein, regardless of the data voltage of a previous image frame, the driving transistor is subjected to data voltage writing and threshold voltage compensation from a same state, thereby reducing or eliminating temporary afterimage problem caused by a hysteresis effect, and a threshold voltage drift problem that impacts brightness uniformity of the display panel.

17. A non-transitory computer-readable storage medium having instructions stored thereon for execution by a processing circuit to realize the method of claim 16.

18. A method of driving a pixel-driving circuit of claim 1, the method comprising:

during the first initialization phase of the image frame, placing the driving transistor to be in an ON state by:

proving, with the light-emission control sub-circuit, voltage of the first power source terminal to the first terminal of the driving transistor, controlled with voltage from the light-emission terminal;

providing, with the reset sub-circuit, voltage of the initial voltage terminal to the gate of the driving transistor, controlled with voltage from the reset signal terminal;

during the second initialization phase of the image frame, placing the driving transistor in an OFF state by:

providing, with the reset sub-circuit, voltage of the initial voltage terminal to the gate of the driving transistor, controlled with voltage from the reset terminal, during the writing phase of the image frame, compensating the driving sub-circuit by:

providing, with the write-compensation sub-circuit, voltage of the data terminal to the driving sub-circuit, controlled with voltage from the signal scanning terminal, during the light-emitting phase of the image frame, driving the light-emitting element to emit light by:

providing, with the light-emission control sub-circuit, voltage of the first power source terminal to the driving sub-circuit, controlled with voltage from the light-emission control terminal so as to cause the driving sub-circuit to drive the light-emitting element to emit light.

19. The method of claim 18, wherein:

the providing, with the reset sub-circuit, voltage during the first initialization phase is further controlled with voltage from the reset signal terminal and the signal scanning terminal;

the providing, with the reset sub-circuit, voltage during the second initialization phase is further controlled with voltage from the reset signal terminal and the signal scanning terminal.

20. The method of claim 19, wherein the reset sub-circuit is further connected to the light-emitting element, the method further comprising:

during the first and the second initialization phases of the image frame, resetting the light-emitting element by having the reset sub-circuit to provide voltages of the initial voltage terminal to the light-emitting element.

* * * * *